United States Patent [19]

Jacoby, Jr. et al.

[11] Patent Number: 4,803,380

[45] Date of Patent: Feb. 7, 1989

[54] COVER AND SUPPORT PLATE ARRANGEMENT FOR WALL MOUNTED DEVICES

[75] Inventors: Elliot G. Jacoby, Jr., Glenside; Michael J. D'Aleo, Ottsville; David G. Luchaco, Macungie; Joel S. Spira, Coopersburg; Richard A. Wagner, Allentown; Stephen J. Yuhasz, Zionsville, all of Pa.; David H. Dowler, Raymond, Me.

[73] Assignee: Lutron Electronics Co., Inc., Coopersburg, Pa.

[21] Appl. No.: 877,229

[22] Filed: Jun. 20, 1986

Related U.S. Application Data

[63] Continuation-in-part of Ser. No. 839,296, Mar. 13, 1986, abandoned.

[51] Int. Cl.[4] ..... H01H 47/00; H01C 10/00

[52] U.S. Cl. ..... 307/157; 307/115; D13/32; 338/159; 338/199; 174/66; 174/55; 174/16.3

[58] Field of Search ..... 307/112, 115, 116, 157, 307/149, 150; 315/291, 200, DIG. 7; 338/159, 116, 179, 184, 198, 199, 182, 189, 200, 330; 174/16 HS, 66, 55; 220/24, 3, 94; 323/905

[56] References Cited

U.S. PATENT DOCUMENTS

| | | | |
|---|---|---|---|
| D. 227,577 | 7/1973 | Mayo | D26/13 B |
| D. 280,095 | 8/1985 | Roszel | D13/32 |
| D. 280,195 | 8/1985 | Roszel | D13/32 |
| 2,828,394 | 3/1958 | Mayzik | 174/55 |
| 3,058,020 | 10/1962 | Balan | 313/46 |
| 3,735,020 | 5/1973 | Licata | 174/66 |
| 3,746,923 | 7/1973 | Spira et al. | 315/291 |
| 3,949,347 | 4/1976 | Gilbreath | 338/200 X |
| 3,990,033 | 11/1976 | Wall | 338/200 |
| 4,042,903 | 8/1977 | Finegan, Jr. | 338/159 |
| 4,085,399 | 4/1978 | Wall | 338/199 X |
| 4,090,167 | 5/1978 | Walker et al. | 338/200 X |
| 4,166,934 | 9/1979 | Marrero | 174/55 X |
| 4,177,445 | 9/1978 | Foreman et al. | 338/198 |
| 4,255,637 | 3/1981 | Matsuda | 174/66 X |
| 4,455,546 | 6/1984 | Roszel | 338/179 |
| 4,500,746 | 2/1985 | Meehan | 174/66 X |
| 4,563,592 | 1/1986 | Yuhasz et al. | 307/115 |
| 4,654,626 | 3/1987 | Carsello | 338/199 X |
| 4,658,088 | 4/1987 | Gartland et al. | 174/66 |

OTHER PUBLICATIONS

LUTRON, "Nova N-600", Nova N-1000 and Nova N-2000-Photocopy A, B and D Septa Dimmer Switches and Nova N-1500-Photocopy D.

LUTRON, *Nova-the Ultimate in Architectural Dimming*, Catalog Sheet, P/N 362-023, 10/83.

(List continued on next page.)

*Primary Examiner*—Bernard Roskoski
*Assistant Examiner*—Paul Ip
*Attorney, Agent, or Firm*—Seidel, Gonda, Lavorgna & Monaco

[57] ABSTRACT

A cover and support plate arrangement for a wall mounted device, such as a wall switch, display, dimmer, etc., for mounting to a wall box embedded in the wall and having overall surface dimensions greater than that of the wall box. The cover plate is juxtaposed over the front surface of the support plate and is spaced therefrom to provide an air gap between the cover plate and the support plate creating a chimney through which air currents may flow. The device includes an electric circuit having a heat generating device, such as a triac, which is thermally connected to the support plate and in series electrically with a controlled load. The cover plate casts a shadow along vertical sides of the support plate such that the vertical sides of the support plate are visible only when viewed at extreme angles with respect to an imaginary line perpendicular to the plane of the support plate or the wall in which the device is mounted. The cover plate appears to float from the wall while proper thermal dissipation is achieved through the chimney between the cover and support plate. Means are disclosed for constructing a low profile, conventionally sized family of wall mounted dimmer switches that meet Underwriters Laboratories operating temperature standards.

218 Claims, 12 Drawing Sheets

OTHER PUBLICATIONS

LUTRON, *Glyder Slide Dimmers and Fan Speed Controls,* P/N 360-186, 4/86.

LUTRON, *Versaplex Multiple Location Remote Controls,* Specification Sheet VS, P/N 362-059, 11/83.

LUTRON, "Aurora", photocopy of control box and cover plate.

LUTRON, *Plan your Interiors in a Different Light with Aurora Lighting Scene Control Centers,* P/N 360-088, 4/85.

LUTRON, *Versaplex Aurora-VA Lighting Scene Control Centers,* P/N 362-165.

LUTRON, Centurion, 362-055, 7/84.

LUTRON, *Nova-ML.* P/N 360-110, 9/85.

Leviton Slide Control Full Range Dimmer, Installation Instructions, Cat. No. 6621.

LUTRON, *Medium Power Incandescent Dimmers,* Catalog Sheet 9/79.

Contractors' Electrical Equipment, p. 9, Oct. 1962.

Dimming & Motor Control Specialists, San Antonio, Texas, *Power Controls Equipment,* Power Controls Corp. Catalog Sheet.

FIG.6
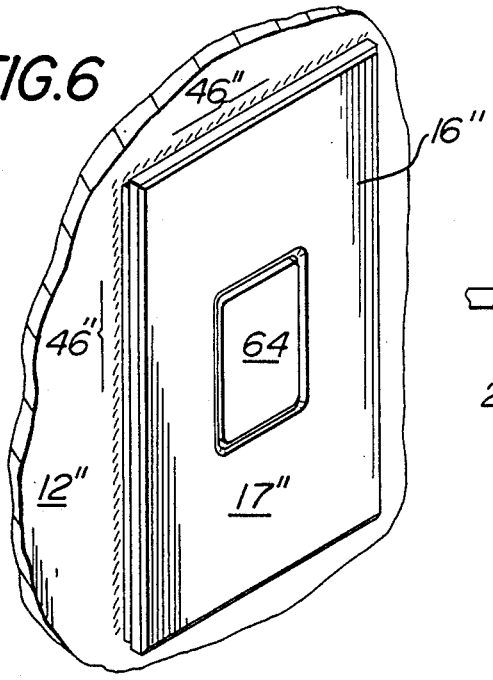
FIG.3
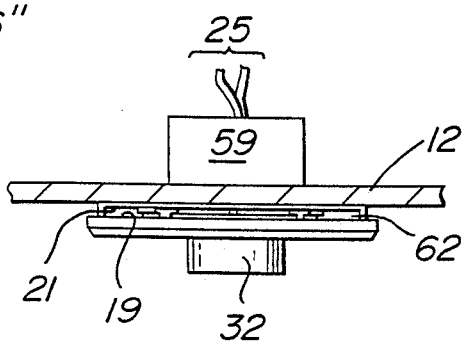
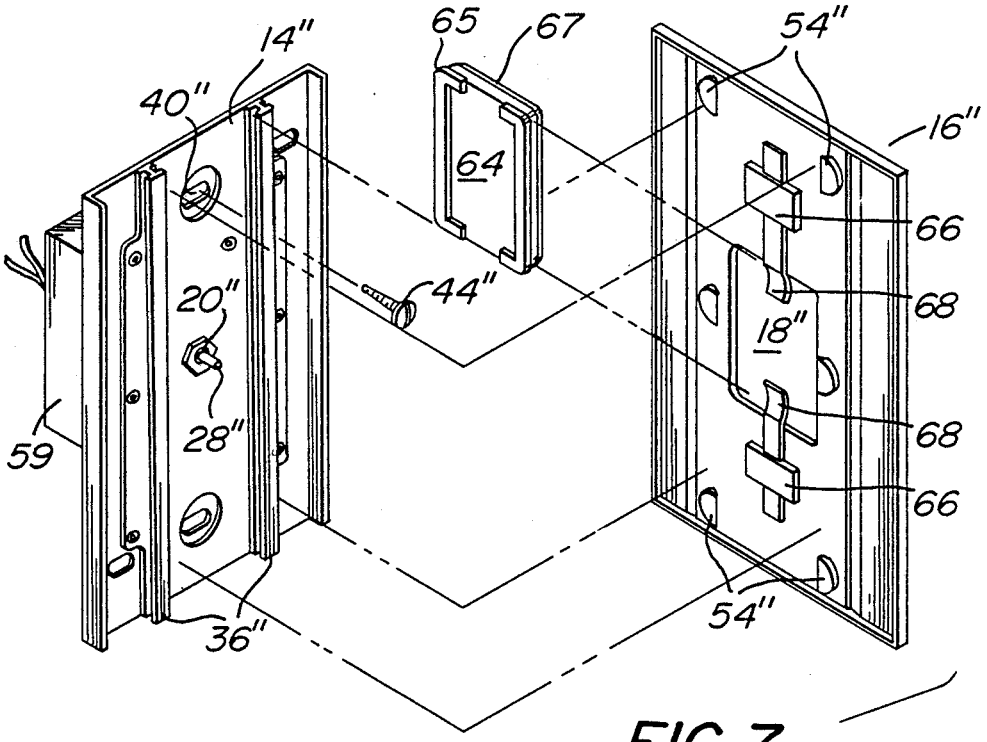
FIG.7

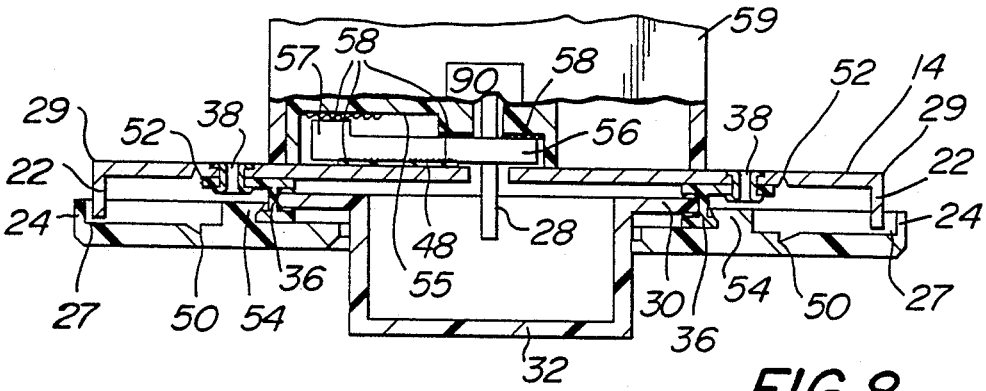
FIG.8
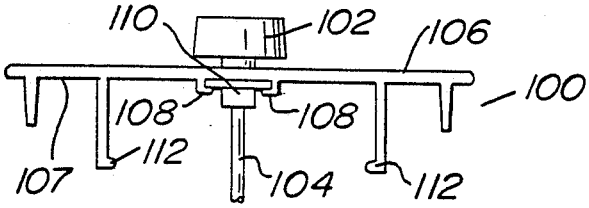
FIG.12
PRIOR ART
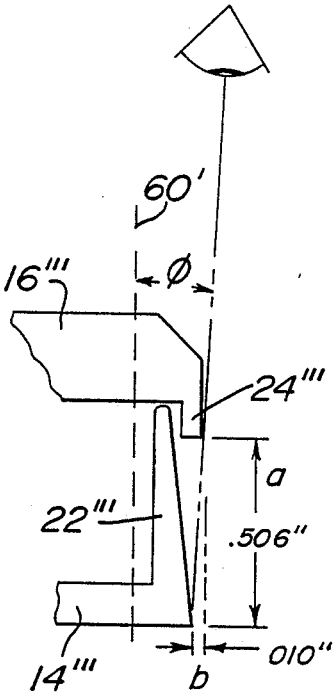
FIG.10
FIG.11
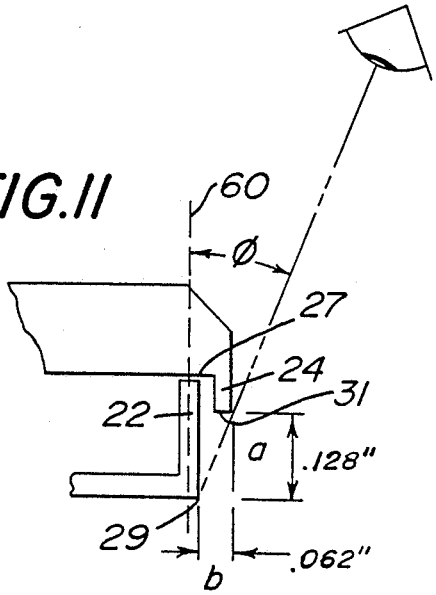

FIG.18
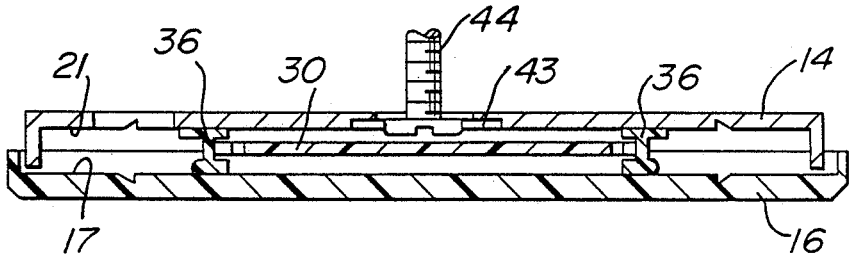
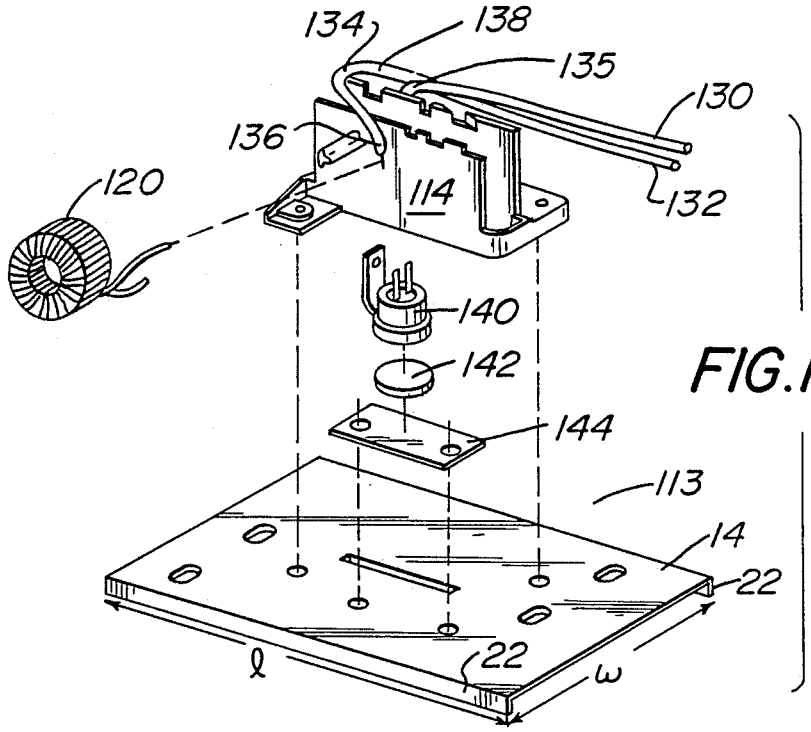
FIG.19

COVER AND SUPPORT PLATE ARRANGEMENT FOR WALL MOUNTED DEVICES

RELATED APPLICATION DATA

This is a continuation-in-part of copending U.S. patent application Ser. No. 839,296 filed Mar. 13, 1986 entitled "Cover And Support Plate Arrangement For Wall Mounted Devices", now abandoned.

This application is also related to the subject matter disclosed and claimed in the following commonly assigned, copending patent applications:

Design patent application Ser. No. 844,297 filed Mar. 13, 1986, entitled "Push Button Switch";

Design patent application Ser. No. 844,296, filed Mar. 13, 1986, entitled "Rotary Dimmer Switch";

Design patent application Ser. No. 844,298, filed Mar. 13, 1986, entitled "Rotary Dimmer Switch"; and Design patent application Ser. No. 844,299, filed Mar. 13, 1986, entitled "Slide Dimmer Switch".

BACKGROUND OF THE IVENTION

The present invention is directed generally to a cover and support plate arrangement for a wall mounted device, such as a wall switch, wall mounted display, etc. In particular, as disclosed herein, but not limited thereto, the present invention is directed to a cover plate and support plate apparatus for a wall switch such as a dimmer or dimmer switch, wherein the support plate is affixed to a wall box embedded in a wall and the cover plate is juxtaposed over the support plate. According to one aspect of the invention, there is provided a support plate and cover plate arrangement for wall mounted apparatus of the type having a controllably conductive device in thermal connection with the support plate and in series with a controlled load and wherein the cover plate appears to float from the wall at wide angles of view. According to a second aspect of the invention, there is provided a low profile cover plate and support plate arrangement for standard size dimmer switches. The dimmer switches meet Underwriters Laboratories operating temperature standards for loads that draw up to about 11.67 amps (1400 W at 120 VAC) according to one embodiment and up to 12.5 amps (1500 W at 120 VAC) according to another embodiment. Neither one of the embodiments requires the use of septa on the support plate, which may be of standard size. According to a third aspect of the invention, the support plate or cover plate includes a pair of separately formed, separately attached rails that may be utilized to affix the cover plate to the support plate without the use of tools and further, in the case of a slide type dimmer switch, may be used to capture and guide the slider. According to a fourth aspect of the invention, a slide type dimmer switch includes a slideable operating member operatively coupled to a cam in contact with a viscous lubricant to provide drag and give the slider an improved "feel". According to a fifth aspect of the invention, there are provided means for maintaining the maximum temperature rise of various parts of a low profile dimmer switch having a smooth and continuous dimming range of up to at least 95% of full voltage within the standards specified by Underwriters Laboratories. By "smooth and continuous", it is meant that a controllably conductive means (such as a triac), and not a mechanical break switch, carries the load current throughout the specified dimming range.

U.S. Pat. No. 3,746,923, incorporated herein by reference discloses a support plate for a dimmer switch wherein the support plate is provided with a series of spaced, outwardly facing septa. These septa are the individual "fins" which project outwards from the flat surface of the support plate. The septa increase the ability of the support plate to dissipate thermal energy generated by a dimmer switch. Such type of dimmer switch shall be referred to herein as a "septa dimmer switch". (The word "septa" is used herein in lieu of the "fins" referred to in the U.S. Pat. No. 3,746,923.) According to the U.S. Pat. No. 3,746,923, a pair of septa is also utilized as a guide for a slider that is connected to the operating member of a linear potentiometer. A cover plate snaps over the septa and has an elongated slot through which access to a handle integral with the slider is provided.

U.S. Pat. No. 3,735,020, also incorporated herein by reference, discloses support plates for dimmer switches, including the septa type support plates of the U.S. Pat. No. 3,746,923, that may be gang mounted onto ganged wall boxes each having a width A. The support plates of the U.S. Pat. No. 3,735,020 dimmer switches each have a width of either 1.5A or 2.5A. For simplicity, these are referred to herein as ∫1.5A" and 2.5A" dimmmer switches. In commercial practice, 1.5A septa dimmer switches of the type disclosed in the U.S. Pat. No. 3,746,923 measure approximately 2¾ inches wide by 4½ inches long and have an overall surface area (including that of the septa) of approximately 54 square inches. Also, in commercial practice, 2.5A finned dimmer switches of the type disclosed in the U.S. Pat. No. 3,746,923 measure approximately 4½ inches square and have an overall surface area (including that of the septa) of approximately 91 square inches. In commercial practice, the support plates of both 1.5A and 2.5A septa dimmer switches have been constructed of aluminum.

It is known that the amount of heat generated by a dimmer circuit is related to the forward voltage drop across the dimmer circuit's triac when operating at a specified current, i.e., the lower the voltage drop, the less heat generated by the triac. Triac selection, however, has not been a major design consideration in septa dimmer switches because such dimmer switches are capable of accommodating a relatively wide range of triacs (i.e., triacs with a relatively high forward voltage drop) while still meeting Underwriters Laboratories standards.

Known 1.5A septa dimmer switches are capable of operating loads that draw currents of up to about 8.33 amps while meeting Underwriter's Laboratories (U.L.) operating temperature standards. Thus, 1.5A septa dimmer switches have been commercially embodied as two separate models, one designed for loads that draw up to 5 amps (600 W at 120 VAC) and another designed for loads that draw up to 8.33 amps (1000 W at 120 VAC). Both have utilized Jedec T0220 type triacs. The 5 amp capacity, 1.5A septa dimmer switch has utilized 25 amp continuous current rated triacs having a forward voltage drop as low as about 1.1 volts at 5 amps forward current. The 8.33 amp capacity, 1.5A septa dimmer switch has utilized 25 amp continuous current rated triacs having a forward voltage drop as low as about 1.2 volts at 8.33 amps. In a 5 amp capacity, 1.5A septa dimmer switch, the triac is mounted on a strip of heat conducting, electrically nonconductive glass tape interposed between the triac and the rear surface of the aluminum support plate. The glass tape and aluminum surface are baked together in well-known manner and the triac is mounted to the glass tape with room temperature vulcanizing rubber such as RTV®. In an 8.33 amp capacity, 1.5A septa dimmer switch, a small copper strip measuring about 1.23 inches by 0.54 inch is eyeleted to the rear surface of the aluminum support plate (a thermally conductive grease such as Dow Corning 340 Silicone Heat Sink Compound is first applied to the contacting surfaces), one side of a beryllium oxide disk is soldered to the copper strip and the triac is soldered to the other side of the beryllium oxide disk.

Similarly, known 2.5 A septa dimmer switches are capable of operating loads that draw currents of up to about 16.67 amps (2000 W at 120 VAC) while meeting U.L. operating temperature standards. Again 2.5A septa dimmer switches have been commercially embodied as two separate models, one designed for loads that draw currents of up to about 12.5 amps (1500 W at 120 VAC) and another designed for loads that draw currents of up to about 16.67 amps (2000 W at 120 VAC). The commercial embodiment of a 12.5 amp capacity, 2.5A septa dimmer switch has utilized press fit type 25 amp continuous current rating triacs having a forward voltage drop as low as about 1.25 volts at 12.5 amps forward current. The commercial embodiment of a 16.67 amp capacity 2.5 septa dimmer switch has utilized press fit type 40 amp continuous current rating triacs having a forward voltage drop as low as about 1.1 volts at 16.67 amps forward current. In the case of the 12.5 amp capacity 2.5A septa dimmer switch, the triac is mounted in the same manner as in the 8.33 amp capacity 1.5A septa dimmer switch, i.e., with a small copper strip measuring about 1.23 inches by 0.54 inch, thermally conductive grease and a beryllium oxide disk. In the case of the 16.67 amp capacity 2.5A septa dimmer switch, triac mounting is the same except that it is known to use a large copper pad measuring about 2.8 inches by 1.7 inches instead of a small copper strip to improve thermal performance.

The above described septa dimmer switches have been manufactured and sold by the assignee of the present application under names such as NOVA and CENTURION. A desirable feature of such septa dimmer switches is that they are capable of continuous and smooth dimming up to at least 95% full voltage while meeting U.L. standards. Septa dimmer switches have also been manufactured and sold by Prescolite Controls, Carrolton, Tex. under the names PRESET and PRESET n-Touch. The devices manufactured by Prescolite Controls are said to be covered by U.S. Pat. No. 4,455,546.

A non-septum dimmer switch having a support plate less than 1.5A in width for controlling loads that draw up to 8.33 amps (1000 W at 120 VAC) while meeting U.L. standards is known and is manufactured by Power Controls Corporation, San Antonio, Tex. and sold under the name "Tog-L-Dim-R". Such dimmer switch, however, is not capable of full range dimming but instead utilizes a mechanical on-off switch to carry full load current when the dimmer switch has been set about 63% of full voltage. The manufacturer claims continuous dimming "through 90%" but tests on actual commercial units show that continuous dimming occurs only up to the above mentioned percentage of full voltage. Thus, a drawback of such dimmer switch is that it is not capable of smooth and continuous dimming over substantially full range. The device manufactured by Power Controls Corporation is said to be covered by U.S. Pat. Nos. 3,990,033 and 4,085,399.

Another non-septum dimmer switch for controlling loads that draw up to 8.33 amps is manufactured by the assignee hereof under the designation D1000 and is capable of substantially full range dimming. However, such dimmer switch has been manufactured with a 2.5A width support plate (having an overall surface area of approximately 42 square inches) to enable it to meet U.L. operating temperature standards. Thus, this dimmer switch suffers from the drawback of requiring a large support plate.

Heretofore, it was believed that a large surface area provided by either a large non-septum support plate or deep septa disposed on the support plate, was required for 8.33 amp and higher capacity dimmer switches to sufficiently dissipate the maximum heat generated by the dimmer circuitry and meet U.L. standards. A major portion of the heat is generated by the triac in the dimmer circuit and, as mentioned, the amount of heat generated by the triac is related to the triac's forward voltage drop at operating current.

A disadvantage of the cover plate and support plate arrangement disclosed in the U.S. Pat. No. 3,746,923 is that, due to the high outwardly projecting septa, the cover plate is distantly spaced from the support plate and appears to float from the wall at only very narrow angles of view. When viewed at wider angles, it is apparent that the cover plate is spaced from the support plate and the wall by a significant distance and the metal septa on the exterior sides are clearly visible. The assignee has manufactured and sold low profile wall mounted apparatus including a support plate with a cover plate that appears to float from the wall at wide angles of view under the names AURORA and VERSAPLEX. However, neither such device houses circuitry that generates substantial amounts of heat. Moreover, neither such device comprises a chimney, as herein described.

Experimentation with novel heat transfer techniques has shown that a large surface area on the support plate is not required for operating loads that draw currents of up to about 12.5 amps while meeting U.L. standards. In fact, on 1.5A and 2.5A width support plates the septa may be removed entirely. The present invention takes advantage of this finding to provide a low profile support and cover plate arrangement that may be used in connection with dimmer switches and other circuitry and that meets U.L. operating temperature standards.

The present invention also takes advantage of findings relating to the use of rails in wall mounted apparatus generally and to the use of viscous lubricants in slide type dimmer switches. The '923 patent teaches septa, including a pair of that serve as rails for a slider, integrally extruded from a support plate. In commercial practice, however, integrally extruded rails have proven to be problematic, primarily due to difficulties in aligning the septa and maintaining the septa and rails within prescribed tolerances. Often, it has been necessary to include an additional costly manufacturing process to align the septa within specified tolerance. A slide dimmer switch manufacturing by Leviton Manufacturing Co., Little Neck, N.Y. under the name "Decora" utilizes a pair of non-extracted plastic rails to guide a slider. But, the rails are integral with each other—they are part of a molded plastic unit comprising two rails, two connecting members and an integral backplate. Thus, the Leviton unit does not permit easy adjustment of rail spacing during manufacture and hence suffers from problems similar to those associated with extruded rails.

It has also been known to grease the rails of a slide dimmer switch to reduce friction between the slider and rails, but this approach is also problematic. One such problem is that the greased rails accumulate dust and other particles, thus defeating the purpose of the grease. Another problem is that the installer may contact the grease and inadvertantly rub it into the cover plate, thereby leaving an unsightly appearance. The present invention overcomes these and other problems associated with prior art dimmer switches.

SUMMARY OF THE INVENTION

Apparatus for wall mounted devices comprises a rectangular support plate for mounting to a wall box embedded in a wall and a rectangular cover plate for mounting to the support plate. The support plate has overall surface dimensions greater than corresponding dimensions of the wall box, a generally flat rear surface and a front surface having only a pair of upstanding portions adjacent vertical side edges thereof. The upstanding portions extend generally perpendicularly outward from the front surface of the support plate. The cover plate is juxtaposed over the front surface of the support plate and has front and rear surfaces and overall surface dimensions greater than corresponding dimensions of the support plate and includes first portions that extend laterally over the vertical side edges of the support plate. The cover plate may also have second portions that extend generally perpendicularly outward from the first portions so that they overlay the upstanding portions of the support plate, but this is not necessary. The ratio of (i) the distance between the rear surface of the support plate and the rearmost surface of the cover plate to (ii) the distance by which the first portions of the cover plate overlay the vertical side edges is less than approximately two to one. The rear surface of the cover plate is spaced from the front surface of the support plate by a distance so as to define an air gap therebetween. Openings into the air gap are provided at opposing horizontal side edges of the support plate. The combination of the pair of upstanding portions, the air gap and the openings into the air gap define a chimney between the support plate and cover plate. The chimney permits air to flow between the support and cover plates, thus dissipating some of the heat generated by circuitry in thermal connection with the support plate. For example, such circuitry may include a controllably conductive device in thermal connection with the support plate and in series with a controlled load.

In the preferred embodiment, the apparatus may also comprise means for invisibly affixing the cover plate to the support plate. As used herein, the term "means for invisibly affixing" refers to a means disposed on the rear surface of the cover plate and on the front surface of the support plate for affixing the cover plate to the support plate that is not apparent to a casual observer. According to the disclosed structure for invisibly affixing the cover plate to the support plate, no tools are required to install or remove the cover plate.

The upstanding portions of the support plate are visible only when viewed at extreme angles with respect to an imaginary line perpendicular to the plane of the support plate. In the disclosed embodiment, the upstanding portions of the support plate are visible only when the apparatus is viewed at angles in excess of 25° with respect to said imaginary line. Further, the cover plate casts a shadow along the vertical side edges of the support plate, thereby giving the appearance that the cover plate is floating from the wall. This shadow also serves to mask the interface between the support plate and the wall.

According to one embodiment of the invention, the support plate/cover plate arrangement disclosed herein is used in connection with a slide type dimmer switch. A first elongated slot is generally centrally disposed in the support plate and a second elongated slot is generally centrally disposed in the cover plate and is in general alignment with the first slot. A linearly adjustable potentiometer is disposed adjacent the rear surface of the support plate and has an operating member extending through and being slidable along the first slot. (As used herein, the term "potentiometer" is meant to include any variable resistor and is not limited to variable resistors of the potentiometer type). A slider is sandwiched between the cover and support plates and is connected to the operating member. The slider has a handle protruding through the second opening so that the slider is slideably moveable to cause a corresponding sliding movement of the operating member. A control means such as a dimmer circuit is operatively connected to the potentiometer for varying an output signal according to the linear setting of the operating member. A cam is operatively connected to the operating member adjacent the rear surface of the support plate. The cam is disposed within a housing greased with a viscous lubricant so as to create a viscous damping or positive drag on the operating member to provide an improved "feel". The viscous lubricant within the housing is not permitted to escape to any outside parts of the dimmer switch. The cam slidingly contacts a member associated with an on-off switch and opens the switch when the operating member has been moved to an extreme end of its travel.

A guide means may be attached to either the front surface of the support plate or the rear surface of the cover plate for guiding the sliding movement of the slider. The guide means comprises a pair of parallel spaced apart rails separately formed from each other and from the cover plate and support plate. In the preferred embodiment, the rails are affixed to the front surface of the support plate but may be affixed to the rear surface of the cover plate. Each rail is disposed on an opposite side of the slot and receives an opposing side of the slider. The rails serve to both guide the sliding movement of the slider and support the slider. In this embodiment, the means for invisibly affixing the cover plate to the support plate comprises tab means disposed on the rear surface of the cover plate (or if the rails are on the rear surface of the cover plate, then the tab means are disposed on the front surface of the support plate.) The tab means snap onto corresponding portions of the rails to hold the cover plate in juxtaposed relationship over the support plate.

Alternatively, the operating member may extend through both the first and second slots and a handle may be connected thereto adjacent the front surface of the cover plate, whereby the slider is not required.

According to the invention, the rails have application to various wall mounted devices and not solely to slide type dimmer switches. Thus, the separately formed rails may be used in connection with rotary dimmer switches, wall mounted push button switches or any other wall mounted device where it is desired to invisibly affix a cover plate to a support plate.

In another embodiment of the invention, the support plate/cover plate arrangement is used in connection with a rotary dimmer switch. In this embodiment, there is a generally centrally disposed first opening in the support plate and a corresponding generally centrally disposed second opening in the cover plate in substantial alignment with the first opening. The first opening receives a rotatable operating member associated with a rotary potentiometer disposed adjacent the rear surface of the support plate. Preferably, the second opening is round and only slightly larger in diameter than a circular control knob that extends through the second opening and is connected to the operating member. Alternatively, the operating member may extend through both the first and second openings and a control knob may be connected thereto adjacent the front surface of the cover plate. The control knob is rotatable to cause a corresponding rotary movement of the operating member. A control circuit is operatively coupled to the potentiometer for varying an output signal according to the rotary setting of the operating member.

In still a third embodiment, there is a generally centrally disposed first opening in the support plate and a corresponding generally centrally disposed second opening in the cover plate in substantial alignment with the first opening. The first opening accommodates an operating member associated with a switch disposed adjacent the rear surface of the support plate. (As used herein, the term "switch", as opposed to "dimmer switch", is used to connotate any type of maintained contact, momentary contact, or mechanical break switch, including, but not limited to a push button on-off switch.) A depressable, spring loaded push button may be disposed in the second opening and is operable, when depressed, to depress the operating member and thereby open and close the switch. Alternatively, the operating member may extend through the second opening and the push button may be connected thereto adjacent the front surface of the cover plate.

The present invention also has application to wall mounted displays, wherein the display is mounted in or adjacent the "floating" cover plate.

A low profile cover plate and support plate arrangement for a dimmer circuit of the type described above is made possible by applying the results of experimentation with heat transfer techniuques. Such experimentation has shown that 1.5A width dimmer switches for operating loads that draw up to 8.33 amps, and that 2.5A width dimmer switches for operating loads that draw up to 12.5 amps, do not require a large surface area on the support plate to meet U.L. operating temperature standards. Thus, a low profile septumless support plate, or low profile, low height septum support plate may be provided. The following performance standards for dimmer switches are specified by U.L.:

1. That the maximum temperature rise on field wiring terminals or on the conductors of the leads intended for field wiring not be more than 30° C. (54° F.);

2. That the maximum temperature rise of any part of the dimmer switch that can contact the field wiring not be more than 35° C. (63° F.); and 3. That the maximum temperature rise of any part that is exposed on the outside of the dimmer switch, other than those indicated in paragraph 2 not be more than 65° C. (117° F.).

According to the invention, an 8.33 amp capacity 1.5A width low profile dimmer switch comprises an aluminum support plate and a 35 amp continuous current rating triac having a forward voltage drop of no greater than about 1.0 volts at a forward current of approximately 8.33 amps. The dimmer switch has a smooth and continuous dimming range up at lest 95% of full voltage. In the preferred embodiment, the support plate has no septa and the overall surface area of the support plate preferably measures approximately 26 square inches. The triac is in thermal connection with the support plate. The triac may have a low thermal resistance from junction to case. In one embodiment, a small copper strip measuring about 1.23 inches by 0.54 inch is eyeleted to the rear surface of the support plate (thermally conductive grease is applied to the mating surfaces of the copper strip and aluminum support plate) and a beryllium oxide disk is interposed between the triac and the copper strip. A connecting lug is soldered to the base of the triac before mounting. In this embodiment, the triac is the only circuit element disposed on the copper strip. In another embodiment, a large copper pad measuring about 2.8 inches by 1.7 inches is eyeleted to the rear surface of the support plate and both the triac and remaining dimmer circuitry are disposed adjacent the copper pad. Again, a thermally conductive grease is applied to the mating surfaces of the copper pad and aluminum support plate, a beryllium oxide disk is interposed between the triac and the copper pad and a connecting lug is soldered to the base of the triac before mounting. In both embodiments, the lead wires from the dimmer circuitry to the outside of a housing surrounding the dimmer circuitry are AWG 12 stranded wire, instead of AWG 16 standard wire utilized in the prior art 8.33 amp capacity 1.5A septa dimmer switches. (Note—the invention is not limited to the use of stranded wires, and solid wires may also be used.) In the first embodiment, it has been observed that, when operating under maximum specified load conditions (8.33 amps), the maximum temperature rise on field wiring terminals or on the conductors of the lead wires intended for field wiring is no greater than 30° C., that the maximum temperature rise of any part of the dimmer switch that can contact field wiring is no greater than 35° C. and the maximum temperature rise of any other part of the dimmer switch that is exposed on the outside is no greater than 65° C. In the second embodiment, it has been observed that, when operating under maximum specified load conditions (8.33 amps), the maximum temperature rise on field wiring terminals or on the conductors of the lead wires intended for field wiring is no greater than 30° C., the maximum temperature rise of any part of the dimmer switch that can contact field wiring is no greater than 35° C. and the maximum temperature rise of any other part of the dimmer switch that is exposed on the outside is no greater than 65° C. Hence, in both cases, these maximum temperature rises are less than those specified by U.L.

Accoridng to the invention, a 11.67 amp capacity 2.5A width low profile dimmer switch comprises a copper support plate and a 35 amp continuous current rating triac having a forward voltage drop of no greater than about 1.05 volts at a forward current of approximately 11.67 amps. The triac is in thermal connection with the support plate. The triac may have a low thermal resistance from junction to case. The dimmer switch has a smooth and continuous dimming range up to at least 95% of full voltage. In the preferred embodiment, the support plate has no septa and on overall surface area of approximately 44 square inches. Preferably, the copper support plate is painted black or has a matt finish to improve its heat radiating ability. The thermal performance of this dimmer switch is further improved by a novel lead wire arrangement that is provided at least within the dimmer switch housing. A pair of AWG 12 stranded lead wires is connected in parallel to each side of the dimmer circuit (i.e., two AWG 12 stranded wires are connected in parallel to a "hot junction" on the supply side and two AWG 12 stranded wires are connected in parallel to a "hot junction" on the load side). (Note—the invention is not limited to the use of stranded wires, and solid wires may be used instead.) In one embodiment, all four wires extend through the housing for connection to the field wiring. In another embodiment, each pair of parallel wires is connected to an AWG 10 stranded wire within the housing and the pair of AWG 10 stranded wires extend through the housing for connection to the field wiring.

In the preferred embodiment of the 11.67 amp capacity 2.5A width low profile dimmer switch, a large copper pad measuring about 2.8 inches by 1.7 inches is eyeleted to the rear surface of the copper support plate and both the triac and remaining dimmer circuitry are disposed adjacent the copper pad. A thermally conductive grease is applied to the mating surfaces of the copper pad and the copper support plate and a beryllium oxide disk is interposed between the triac and the copper pad. A connecting lug is soldered to the base of the triac before mounting. In this embodiment, it has been found that, when the dimmer switch is operating at maximum specified load (11.67 amps at 120 VAC, i.e., 1400 W), the maximum temperature rise on field wiring terminals or on the conductors of the leads intended for field wiring is no greater than 30° C., the maximum temperature rise of any part of the dimmer switch that can contact field wiring is no greater than 35° C. and the maximum temperature rise of any part that is exposed on the outside of the dimmer is no greater than 65° C. These maximum temperature rises are thus less than those specified by U.L.

A 12.5 amp capacity 2.5A width low profile dimmer switch, according to the present invention, meets U.L. performance standards without the use of a copper support plate, without the use of a large copper pad eyeleted thereto for triac mounting, and without the four lead wire arrangement discussed above. Moreover, the 12.5 amp version meets U.L. performance standards while providing a smooth and continuous dimming range up to at least 95% of full voltage.

According to the preferred embodiment, a 12.5 amp capacity 2.5A width low profile dimmer switch comprises an aluminum support plate and a 35 amp continuous current rating triac having a forward voltage drop of no greater than about 1.05 volts at forward current of approximately 12.5 amps. The triac is in thermal connection with the support plate. The triac may have a low thermal resistance from junction to case. As mentioned, the dimmer switch has a smooth and continuous dimming range up to at least 95% of full voltage. Preferrably, the support plate has no septa and an overall surface area of no greater than about 44 square inches. The aluminum support plate need not be painted black but is preferably provided with a matt finish to meet U.L. performance standards. The lead wires from the dimmer circuitry to the outside of a housing surrounding the dimmer circuitry are AWG 10 standed wire, but the invention is not limited to the use of stranded wires—solid wires may also be used.

The 12.5 amp capacity version of the 2.5A width low profile dimmer switch employs a first means for thermally isolating the interior of a housing covering the dimmer circuit (i.e., the space within the housing) from the support plate and a second means for thermally isolating the wall box (to which the dimmer switch is mounted) from the support plate. In the preferred embodiment, the first means comprises a plastic shield interposed between the housing and the support plate and suitably sized so as to isolate both the interior of the housing and the housing itself from all parts of the support plate (except for contact provided by mounting eyelets). Preferably, an air gap is provided between the housing (and its interior) and the support plate by the plastic shield to increase the thermal resistance between them. All dimmer circuitry, except the triac, is disposed on the plastic shield. The triac is in thermal connection with the support plate by means of a small copper strip measuring about 1.23 inches by 0.54 inch eyeleted to the rear surface of the support plate and a beryllium oxide disk interposed therebetween. Preferably, the second means comprises a piece of fishpaper such as Armite manufactured by Spaulding Fibre Company, Tonawanda, N.Y., disposed on the rear surface of the support plate and suitably sized so as to insulate all parts of the support plate from all parts of the wall box (except for the mounting screws). It has been found that when the above described dimmer switch is operating at maximum specified load (12.5 amps at 120VAC i.e., 1500 W), the maximum temperature rise on field wiring terminals or on the conductors of the leads intended for field wiring is no greater than 30° C., the maximum temperature rise of any part of the dimmer switch that can contact field wiring is no greater than 35° C. and the maximum temperature rise of any part that is exposed on the outside of the dimmer switch is no greater than 65° C.

In sum, as embodied as a dimmer switch, the present invention permits construction of a dimmer switch for controlling loads that draw up to 8.33 amps on a 1.5A width low profile support plate and construction of a dimmer switch for controlling loads that draw up to 12.5 amps on a 2.5A width low profile support plate. Septa are not required on the support plate to meet U.L. operating temperature standards. Thus, installed prior art septa dimmer switches may be substituted with low profile dimmer switches of the present invention on a one for one basis. No wall boxes need to be added or removed. The new installation will have a more aesthetically pleasing appearance due to its low profile and floating appearance. Still further, the present invention permits production of a family of low profile, standard size 5 amp, 8.33 amp and 11.67 or 12.5 amp capacity U.L. approved dimmer switches, which heretofore has not been possible. Thus, plural low profile dimmer switches of varying load size (e.g., 600 W, 1000 W, 1400 W and/or 1500 W) may be ganged in the manner disclosed in the U.S. Pat. No. 3,735,020.

Further advantages of the invention will become apparent to those skilled in the art upon particularly describing a preferred embodiment of the invention.

For the purpose of illustrating the invention, there is shown in the drawings a form which is presently preferred; it being understood, however, that this invention is not limited to the precise arrangements and instrumentalities shown.

BRIEF DESCRIPTION OF THE DRAWINGS

FIG. 3 is a top plan view of the slide dimmer switch illustrated in FIGS. 1 and 2.

FIG. 6 is a perspective view of a push button wall switch constructed according to the teachings of the present invention.

FIG. 7 is an exploded view of the wall switch illustrated in FIG. 6.

FIG. 8 is a cross section view taken along line 8—8 of FIG. 1.

FIG. 10 is a viewing analysis of a prior art dimmer switch and illustrates the narrow angle of view at which the cover plate appears to float from the wall.

FIG. 11 is a viewing analysis of a support plate/cover plate constructed according to the teachings of the present invention and illustrates the wide angle of view at which the cover plate appears to float.

FIG. 12 illustrates details of another prior art dimmer switch.

FIG. 18 is a cross section taken along line 18—18 of FIG. 2.

FIG. 19 is an exploded isometric view of the rear side of one embodiment of a 8.33 amp capacity 1.5A width non-septum dimmer switch according to the present invention.

DETAILED DESCRIPTION OF THE PREFERRED EMBODIMENT OF THE INVENTION

Figure 1:
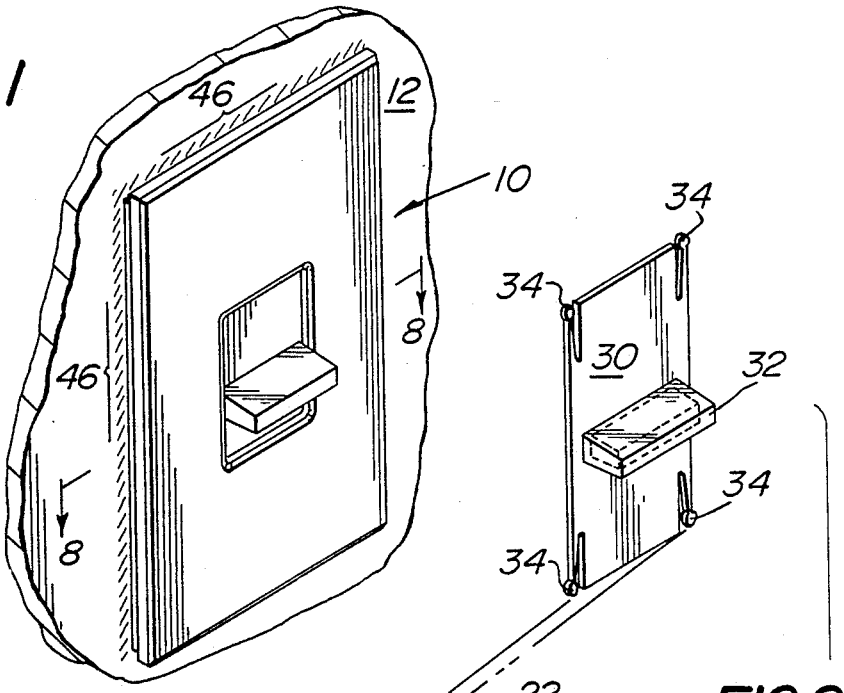
FIG. 1 is a perspective view of a slide dimmer switch constructed according to the teachings of the present invention.
Figure 2:
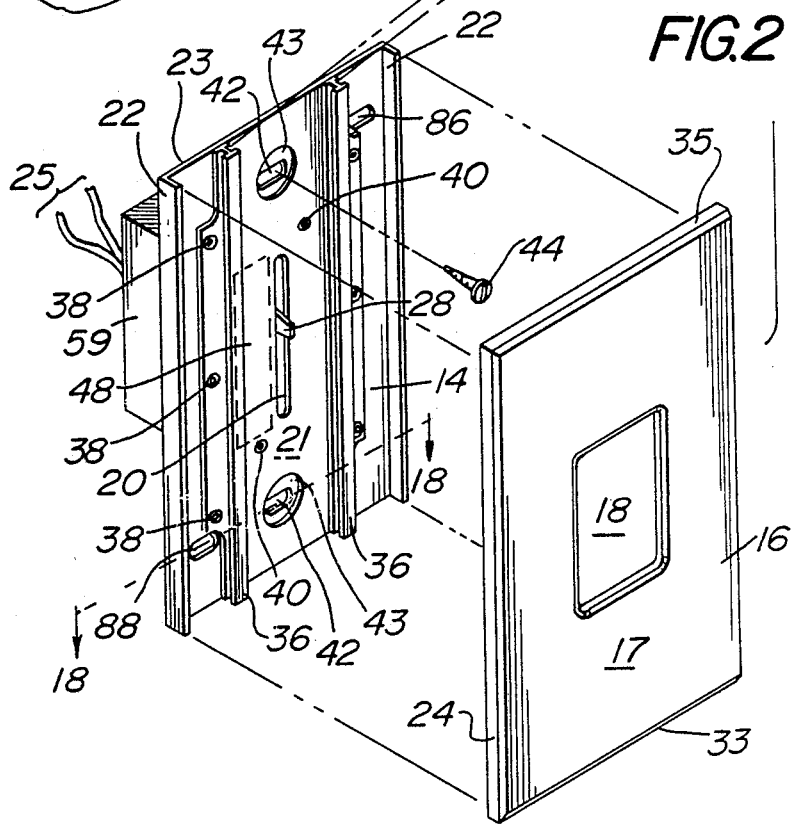
FIG. 2 is an exploded view of the slide dimmer switch illustrated in FIG. 1.

Referring now to the drawings, wherein like numerals represent like elements, there is illustrated in FIGS. 1 and 2 a cover and support plate arrangement labeled generally 10. The arrangement 10 comprises a generally rectangular support plate 14 and a generally rectangular cover plate 16. The support plate 14 is adapted to be mounted to a conventional wall box 80 embeded in a wall 12. See FIGS. 1 and 16. Shallow pan head screws 44 communicate with recessed holes 42 for securing support plate 14 to the wall box 80 by threading engagement with aligned threaded holes 82, 84 in the wall box 80. The use of shallow pan head screws 44 and recessed holes 42 provides a small clearance between the head of screw 44 and a slider, as will become evident hereinafter. See FIG. 18.

Figure 16:
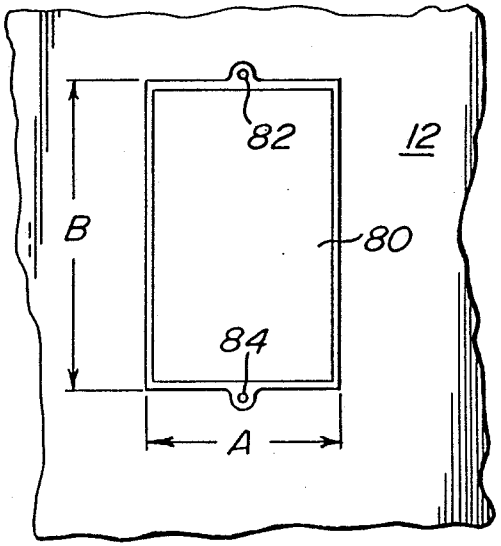
FIG. 16 illustrates a wall box embedded in a wall for mounting the cover and support plate arrangement of the present invention.
Figure 17:
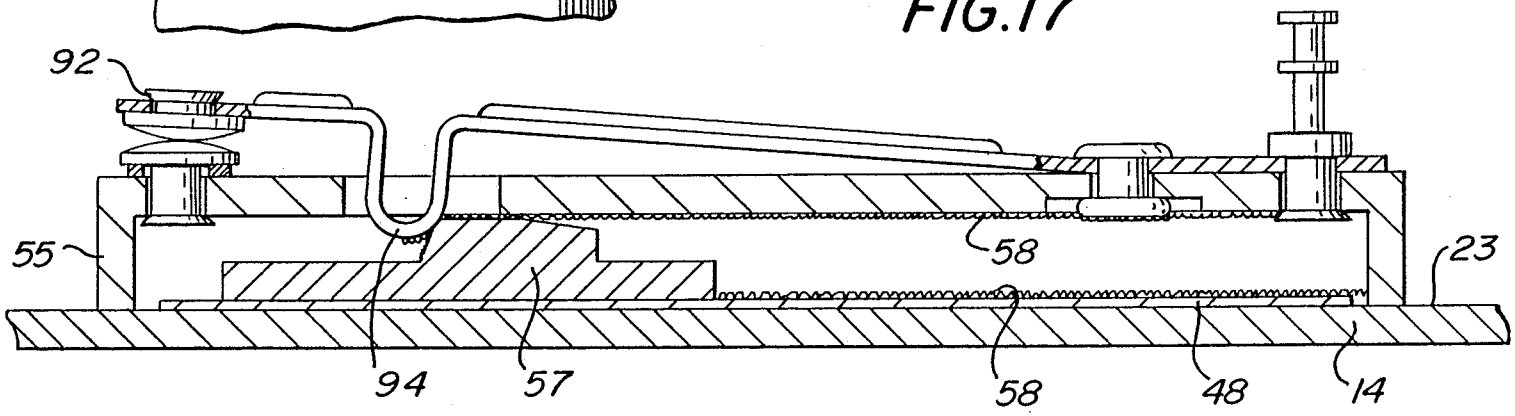
FIG. 17 is a cross section of an on-off switch associated with a slide dimmer switch of the present invention.

As illustrated in FIG. 16, wall box 80 has a width A and a length B. As is known in the art, commercially available wall boxes of the type shown measure about 3-9/32 inches long by about 1-31/32 inches wide. The support plate 14 has overall surface dimensions including a length and a width which are greater than the corresponding length B and width A of the wall box 80, i.e., the overall surface dimensions of the support plate 14 are greater than corresponding dimensions of the wall box. Preferably, the width of support plate 14 is either 1.5A or 2.5A and the length of support plate 14 is no greater than about 3A. Support plate 14 also includes offset mounting holes 86, 88 for the reasons more fully set forth in U.S. Pat. No. 3,735,020. Mounting holes 86, 88 need not be recessed.

As illustrated, the support plate 14 has a generally flat rear surface 23. Preferably the front surface 21 is generally flat (i.e., no septa) and has a pair of upstanding portions 22 disposed along opposing vertical side edges 29 thereof. See FIGS. 13, 14 and 15. As shown, the upstanding portions 22 extend generally perpendicularly outward from the front surface 21 of support plate 14. Preferably, the distance between the rear surface 23 of support plate 14 and the top of upstanding portions 22 is no greater than about 0.2 inches. If desired, support plate 14 may be provided with septa (not shown) on the front surface 21, provided that the height of the septa do not exceed that of upstanding portions 22 and further provided that the relationships disclosed herein are maintained. Septa, however, are not required in the practice of the invention.

Figure 13:
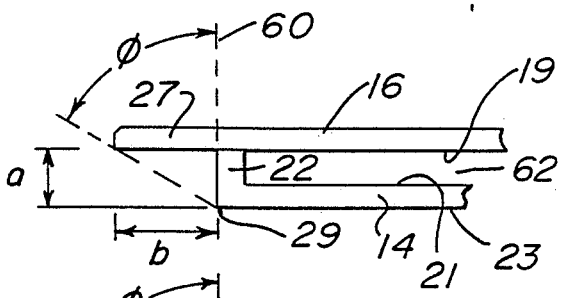
FIGS. 13, 14 and 15 illustrate various embodiments of a cover plate according to the present invention.
Figure 14:
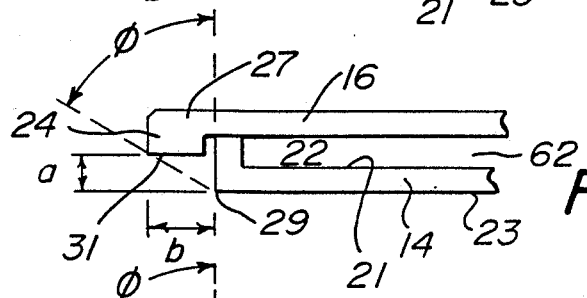
Figure 15:
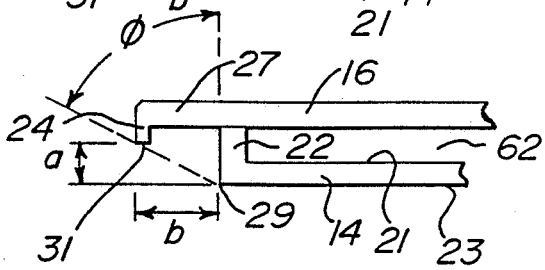

As illustrated in FIG. 2, the cover plate 16 is generally rectangular and is normally juxtaposed over the front surface 21 of support plate 14. The cover plate 16 has overall surface dimensions, including a length and a width, greater than the corresponding length and width of the support plate 14, i.e., the overall surface dimensions of the cover plate 16 are greater than corresponding dimensions of the support plate 14. As best illustrated in FIGS. 8, 11 and 13, the cover plate 16 has at least a pair of first portions 27 that extend laterally over the vertical side edges 29 of support plate 14. If desired, the cover plate may also be provided with second portions 24 that extend generally perpendicularly outward from the periphery of the first portions 27 so that the second portions 24 overlay the upstanding portions 22 as best illustrated in FIGS. 14 and 15. The second portions 24 are not necessary, but may be provided to improve the aesthetic appearance of the invention. For convenience only, the invention disclosed herein is shown as including the second portions 24 and their disclosure should not be construed as a limiting feature, except as otherwise noted. When second portions 24 are provided, it is preferable that the depth of second portions 24 be less than the depth of upstanding portions 22, as illustrated in FIGS. 8, 11, 14 and 15. Preferably, as illustrated in FIG. 13, when no second portions 24 are provided, the ratio of (i) the distance "a" between the rear surface 23 of the support plate 14 and the rear surface 19 of the first portion 27 to (ii) the distance "b" by which the first portions 27 extend laterally over the vertical side edges 29 is less than approximately two to one. Similarly, as illustrated in FIGS. 11, 14 and 15, when second portions 24 are provided, the ratio of (i) the distance "a" between the rearmost portion 31 of second portion 24 and the rear surface 23 of support plate 14 to (ii) the distance "b" by which the first portions 27 extend laterally over the vertical side edges 29 is less than approximately two to one. (As used herein, the term "rearmost surface", as opposed to "rear surface", when used in connection with cover plate 16, refers to the surface 19 of the embodiment illustrated in FIG. 13 and to the portion 31 of the embodiment illustrated in FIGS. 14 and 15.) FIG. 11 illustrates that, according to one practice of the invention having second portions 24, a dimension for "a" is 0.128" and a dimension for "b" 0.062".

Generally, in the case of both embodiments, it can be said that the ratio of (i) the distance between the rear surface of the support plate (surface 23) and the rearmost surface of the cover plate (surface 19 in FIG. 13; surface 31 in FIGS. 11, 14 and 15) to (ii) the distance by which the first portions overlay the vertical side edges should be less than approximately two to one.

Also, as illustrated in FIGS. 11, 13, 14 and 15, when the above mentioned ratio is maintained, the upstanding portions 22 of support plate 14 will be visible only when viewed at extreme angles with respect to an imaginary line 60 that is perpendicular to the plane of the support plate 14. With the dimensions specified in FIG. 11 (i.e., a=0.128", b=0.062"), the upstanding portions 22 will be visible only when viewed at an angle $\phi$ in excess of 25° with respect to the imaginary line 60. The first portions 27 of cover plate 16 cause a shadow 46 to be cast around the periphery of the support plate 14 (FIG. 1) thereby giving the appearance that the cover plate 16 is "floating" from the wall within an angle of view that exceeds 50°, i.e., plus or minus 25° from the imaginary line 60. The shadow 46 also masks imperfections in the portion of the wall surrounding the support plate 14.

If desired, cover plate 16 may also be provided with portions 35, 33 that extend perpendicularly outward from upper and lower horizontal edges thereof. See FIG. 2. Portions 35, 33 serve to self-align the cover plate with respect to the support plate, as will become evident hereinafter.

FIG. 10 illustrates one present commercial embodiment of the slide dimmer switch disclosed in the U.S. Pat. No. 3,746,923. As illustrated therein, the dimension a=0.506" and the dimension b=0.010". With such dimensions, the angle at which the upstanding portions 22''' appears to be invisible is less than 2° with respect to imaginary line 60'. That is, the overall field of view at which cover plate 16''' appears to "float" from the wall is 4°, i.e., plus or minus 2° from imaginary line 60'.

Turning now to FIG. 3, it will be seen that there is an air gap 62 between the rear surface 19 of cover plate 16 and the front surface 21 of support plate 14. See also FIGS. 13, 14 and 15. Preferably, the width of the air gap 62 (i.e., the distance between the rear surface 19 of cover plate 16 and the front surface 21 of support plate 14) is no greater than about 0.15 inch. Openings into the air gap 62 are located between the cover plate 16 and the support plate 14 at upper and lower horizontal edges of the support plate 14 and define inlets to and outlet from the air gap 62, as best illustrated in FIG. 3. The combination of the pair of upstanding portions 22, the air gap 62 and the inlets and outlets define a chimney through which air currents may flow to dissipate heat generated by a voltage control means in thermal connection with the support plate 14. For example, a dimmer circuit may be disposed within a housing 59 adjacent the rear surface 23 of support plate 14 and may have a triac in thermal connection with the support plate 14. The support plate 14 is preferably constructed of a heat conductive metal such as aluminum or copper to facilitate heat dissipation. Moreover, the front surface 21 of support plate 14 and the rear surface 19 of cover plate 16 may be painted black or provided with a matt finish to improve the thermal performance of the device.

The discussion thus far applies to all embodiments of the invention disclosed herein. Thus, the support plate/-cover plate arrangement discussed thus far has application, for example, to slide dimmer switches, rotary dimmer switches and wall mounted push button switches, as well as any other type of wall mounted devices including wall mounted displays and other types of wall mounted control devices. Application of the teachings of the present invention to examples of a slide dimmer switch, rotary dimmer switch and wall mounted push button switch will now be discussed. Except as noted in the appended claims, these examples are not intended as limiting in any respect.

Figure 4:
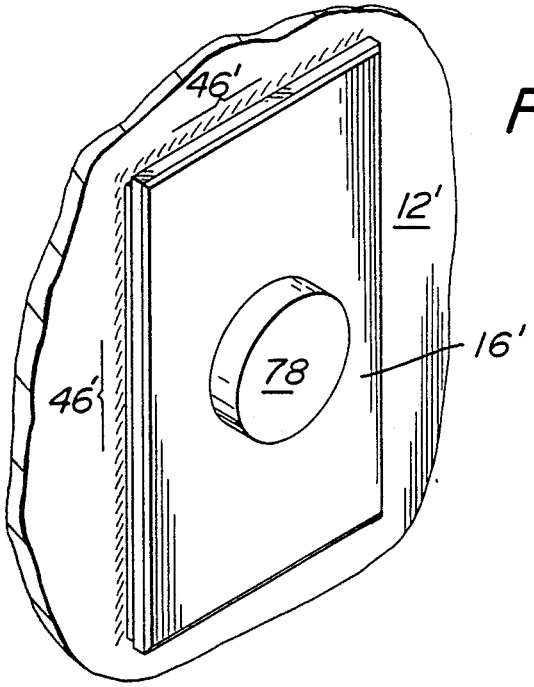
FIG. 4 is a perspective view of a rotary dimmer switch constructed according to the teachings of the present invention.
Figure 5:
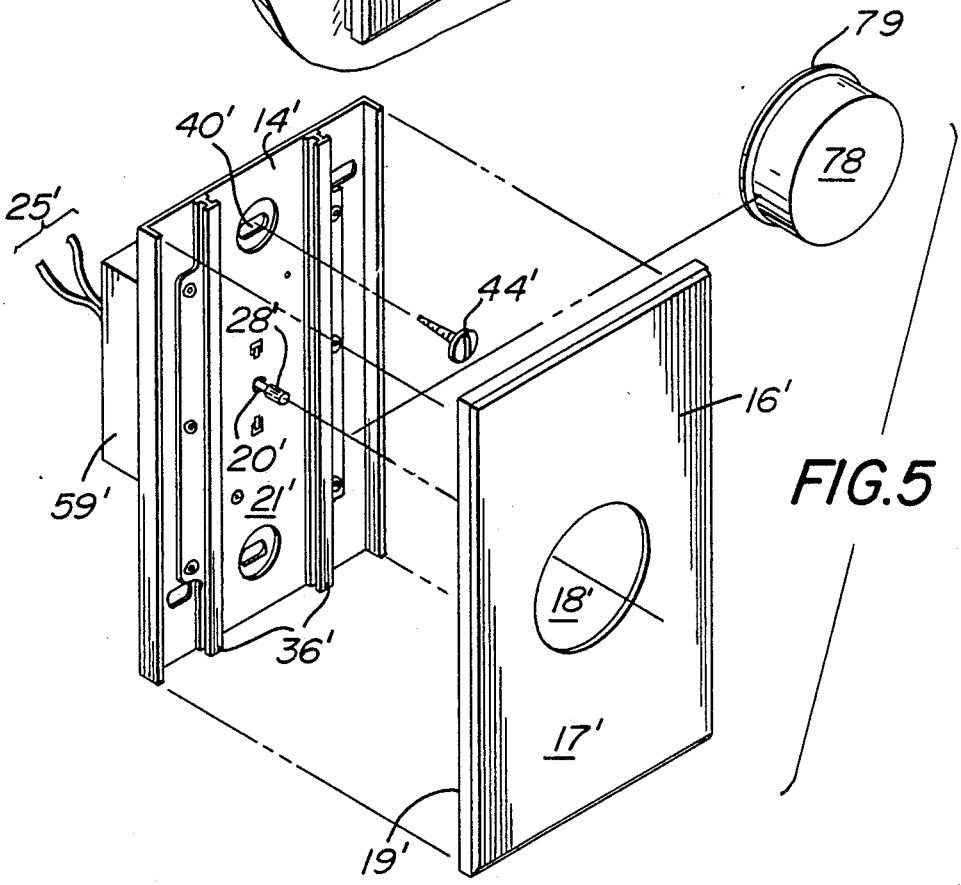
FIG. 5 is an exploded view of the rotary dimmer switch illustrated in FIG. 4.
Figures 20, 21:
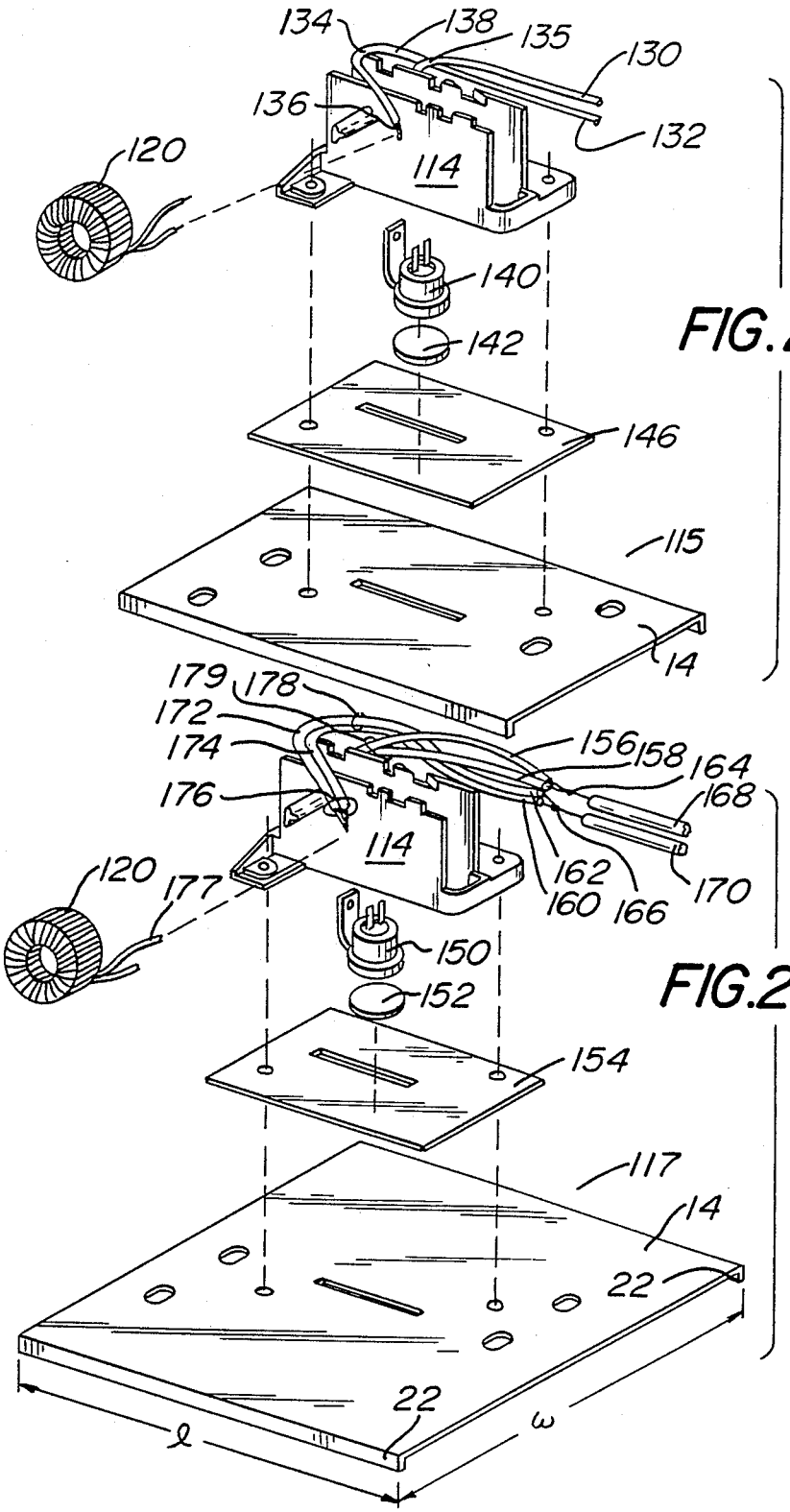
FIG. 20 is an exploded isometric view of the rear side of another embodiment of a 8.33 amp capacity 1.5A width non-septum dimmer switch according to the present invention.
FIG. 21 is an exploded isometric view of the rear side of a 11.67 amp capacity 2.5A width non-septum dimmer switch according to the present invention.

FIGS. 1, 2, 3, 8, 17 and 18 apply to a slide dimmer switch embodiment of the present invention. FIGS. 4 and 5 apply to a rotary dimmer switch embodiment of the present invention and FIGS. 6 and 7 apply to a wall mounted push button switch embodiment of the present invention. FIGS. 19, 20 and 21 are applicable to any dimmer switch application of the present invention.

A slide dimmer switch embodiment of the present invention will be discussed first.

Generally centrally disposed in the support plate 14 is an elongated slot 20. In substantial alignment therewith is a generally centrally disposed elongated opening 18 in the cover plate 16. The width of the opening 18 is greater than the width of slot 20 for reasons that will become apparent hereinafter. As disclosed in the U.S. Pat. No. 3,746,923, and as shown in FIGS. 2 and 8, a linearly adjustable potentiometer 90 is disposed adjacent the rear surface 23 of the support plate 14 and has an operating member 28 extending through the slot 20 and being slidable therealong. The potentiometer is operatively coupled to a well known voltage control means such as a dimmer circuit disposed within housing 59, as also disclosed in the U.S. Pat. No. 3,746,923 and in a manner disclosed herein. Housing 59 is affixed to the rear surface 23 of support plate 14 by low profile eyelets 40. The holes in which eyelets 40 are disposed may contain recesses so that the heads of eyelets 40 are flush with the front surface 21 of support plate 14 to facilitate uninhibited sliding motion of a slider 30 that is guided by guide means discussed hereinafter. Additionally, mounting holes 42 disposed at upper and lower ends of support plate 14 are each surrounded by recessed regions 43 disposed on the front surface 21 of the support plate 14 so as to provide counterbored portions into which heads of screws 44 may seat. When fully inserted into holes 42, the heads of screws 44 are preferably substantially flush with front surface 21. See FIG. 18.

The slider 30 is operatively coupled to the operating member 28 and has a handle 32 that protrudes through the opening 18 in the cover plate 16. The slider 30 is slideably moveable along the guide means to cause a corresponding sliding movement of the operating member. The voltage appearing at the output of wires 25 thus varies according to the linear setting of the slider 30 (and hence operating member 28) as is well-known in the art.

According to the preferred embodiment of the invention, the guide means comprises a pair of parallel spaced apart rails 36 separately formed from and separately attached to the support plate 14. Each rail 36 is secured to the front surface 21 of the support plate 14 by means of three waxed eyelets 38. The eyelets 38 are positioned so that they are aligned with tabs 54 disposed on the rear surface 19 of cover plate 16 for reasons described herein. As illustrated in FIG. 8, the portion of the eyelets 38 that protrude through the rear surface 23 of support plate 14 are recessed so that rear surface 23 will sit flat against wall 12. Each rail 36 is disposed on an opposing side of slot 20 and is arranged to accommodate slider 30. In particular, each rail 36 engages an opposite side of the slider 30, as illustrated in FIGS. 2, 8 and 18 so that the slider 30 is both guided and supported by rails 36. Rails 36 may be constructed of a metal such as aluminum or of a resilient plastic material such as nylon. The use of separately attached rails allows adjustment of spacing tolerance during manufacture thus eliminating the problems associated with extruded rails used in the prior art. The use of separately attached rails also permits selection of rail material without altering the manufacturing process.

As illustrated in the drawings (e.g. FIG. 2), the rails 36 extend the full length of the support plate 14 and overhang the horizontal edges of the support plate 14 by a small amount. Preferably, the rails 36 overhang the support plate 14 by a small distance so that opposing horizonal portions 35, 33 of cover plate 16 cause the cover plate 16 to be evenly aligned (in a vertical direction) with respect to support plate 14. In the preferred embodiment, the support plate 14 is approximately 4½ inches (more particularly, 4.44 inches) in length, the inside distance between horizontal portions 35, 33 is approximately 4.515 inches and the rails 36 overhang the horizontal edges of support plate 14 by approximately 0.02 inch at each end. Overhanging the rails 36 in this manner has been found to be particularly beneficial when plural dimmer switches are ganged since the cover plates 16 do not slide vertically and thus remain aligned with one another.

In the preferred practice of the invention, the height of the rails 36, i.e., the distance from the top of rails 36 to the front surface 21, is no greater than about 0.15 inches. The rails are grooved on their inside edges as best shown in FIGS. 8 and 18 to define a track in which slider 30 rides. Moreover, the rails 36 are grooved on their outside edges, as also shown in FIGS. 8 and 18, to facilitate engagement with tabs 54.

Slider 30 may have a plurality of prongs 34 for maintaining slider 30 in sliding engagement with the grooves in rails 36, as disclosed in the U.S. Pat. No. 3,746,923. Preferably, the distance between slider 30 and the front surface 21 is no greater than about 0.045 inches. This small clearance is facilitated by the counterbored mounting holes 42 and low profile pan head screws 44, as best illustrated in FIG. 18. This arrangement also permits the overall depth of the dimmer switch to be kept to a minimum.

As also disclosed in the U.S. Pat. No. 3,746,923, operating member 28 has a cam 56 associated therewith. See FIG. 8. The cam 56 is located adjacent the rear surface 23 of the support plate 14 and is operatively connected to the operating member 28. The cam 56 is provided with a cam tab 57 that has a portion that extends away from the rear surface 23 of the support plate 14, as shown. Unlike the dimmer switch of the U.S. Pat. No. 3,746,923, however, a viscous lubricant is provided within a housing in which the cam 56 and cam tab 57 ride. The cam tab 57 moves (i) between housing surface 55 and a strip of Teflon® tape 48 disposed on the rear surface 23 of support plate 14 and (ii) in contact with a viscous lubricant 58. See FIGS. 8 and 17. Similarly, cam 56 moves between housing surface 55 and viscous lubricant 58, as shown. Viscous lubricant 58 is disposed on the housing surface 55 and on the surface of Teflon® tape 48 at all points where cam tab 57 and cam 56 may contact either the housing surface 55 or Teflon® tape 48. Since viscous lubricant 58 is contained within internal parts of the dimmer switch, it does not cause the problems hereinbefore described. More importantly, however, the viscous lubricant is not added to reduce friction, as in the prior art. Instead, the viscous lubricant 58 provides a viscous damping of the sliding movement of the operating member 28 so as to provide an improved "feel" as slider 30 is moved from one extreme end of its travel to the other. Any suitable grease such as that produced by the Nye Company under the name Nyogel 865 may be used for viscous lubricant 58.

As disclosed in the U.S. Pat. No. 3,746,923, an on-off switch 92 may be associated with the voltage control means 26. See FIG. 17. The cam tab 57 slidingly contacts a member 94 associated with the on-off switch and opens the switch when the operating member has been slid to an extreme end of its travel. This feature is fully disclosed in the U.S. Pat. No. 3,746,923.

As best shown in FIG. 8, the slider 30 is sandwiched between the cover plate 16 and support plate 14 and the handle 32 protrudes through opening 18. Alternatively, however, the operating member 28 could extend through both the slots 18, 20 and a handle could be affixed to the operating member 28 adjacent the front surface 17 of the cover plate 16, whereby slider 30 is not required. (See FIG. 1).

According to the embodiment of the slide dimmer disclosed herein, the means for invisibly affixing the cover plate 16 to the support plate 14 comprises a plurality of tabs 54 disposed on and integral with the rear surface 19 of the cover plate 16. As illustrated in FIG. 8, the tabs 54 engage with corresponding portions of rails 36 so that the cover plate 16 snaps thereon. FIG. 7 also illustrates the use of tabs (54'') to engage rails (36'') disposed on the support plate. As previously mentioned, the eyelets 38 and tabs 54 are preferably positioned so that they are in alignment when cover plate 16 is affixed to the rails 36. More particularly, it is preferred that there be three equidistantly spaced eyelets 38 affixing each rail 36 to support plate 14 and three corresponding, equidistantly spaced tabs 54 on each side of surface 19 of cover plate 16 in alignment with eyelets 38. It has been found that positioning the eyelets 38 and tabs 54 in this manner provides strength and stiffness to the rails 36 in the direction of the shear force applied by the tabs 54.

The present invention is not limited to rails disposed on the support plate. Those skilled in the art will readily recognize that the rails 36 could be affixed to the rear surface 19 of the cover plate 16 and the slider 30 disposed therebetween as before described. In such case, tabs 54 would be disposed for cooperative engagement with rails 36 on the front surface 21 of support plate 14. The present invention is also not limited to the use of rails with slide type dimmer switches. As described below, the use of separately attached rails has application wherever it is desired to affix a cover plate to a support plate invisible and without the use of tools.

As illustrated in FIG. 8, both the cover plate 16 and the support plate 14 may have notched portions 50, 52 respectively. As explained in U.S. Pat. No. 3,735,020, the notched protions facilitate "ganging" of a plurality of switches by breaking off portions of the support plate 14 and cover plate 16 at the notches.

Referring now to FIGS. 4 and 5, a rotary dimmer switch constructed according to the teachings of the present invention will be explained. Except as noted, the above description is applicable to the rotary dimmer switch.

As before, the rotary dimmer switch comprises a support plate 14' and a cover plate 16'. The cover plate 16' is juxtaposed over the support plate 14' and casts a shadow 46' around the periphery of the support plate 14' so as to give the appearance that cover plate 16' is "floating" from wall 12', as previously explained. Generally centrally disposed in the support plate 14' is a first opening 20'. The first opening 20' accommodates a rotary operating member 28' protruding therethrough. Cover plate 16' has a corresponding generally centrally disposed second opening 18' in substantial alignment with the first opening 20', as shown. Preferably, the second opening 18' is round and has a diameter slightly larger than the diameter of a control knob 78 that protrudes therethrough. A voltage control means disposed within housing 59' and having a triac in thermal connection with support plate 14' comprises a rotary potentiometer (not shown) disposed adjacent the rear surface of the support plate 14'. The rotary potentiometer is operatively connected to the rotary operating member 28' extending through the opening 20'. The control knob 78 is rotatable to cause a corresponding rotary movement of the operating member 28' and thereby vary the output signal appearing at the output of wires 25', as is well-known in the art.

In the embodiment illustrated in FIG. 5, control knob 78 has a portion 79 that is sandwiched between the cover plate 16' and support plate 14' while the remainder extends through opening 18'. Alternatively, however, the operating member 28' could extend through both the openings 18', 20' and the circular control knob could be affixed to the operating member 28' adjacent the front surface 17' of cover plate 16', whereby the portion 79 is not required.

Figure 9:
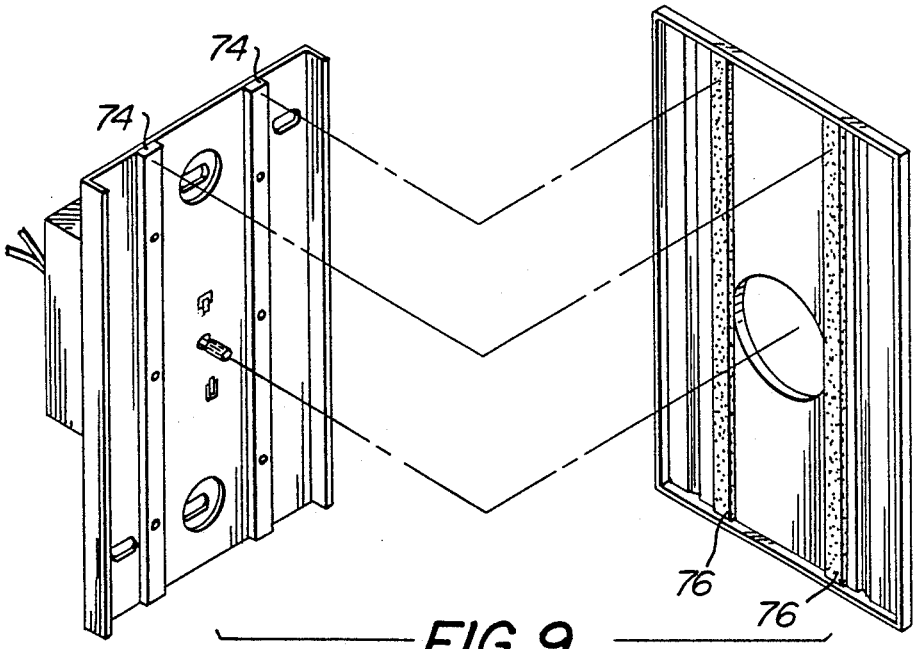
FIG. 9 illustrates alternative means for invisibly affixing the cover plate to the support plate.

As before, the rotary dimmer switch illustrated in FIGS. 4 and 5 may be equipped with a pair of rails 36' on either the front surface 21' of support plate 14' or the rear surface 19' of cover plate 16' for locking engagement with tabs disposed on the other of the rear surface 19' of cover plate 16' or front surface 21' of the support plate 14'. Alternatively, the means for invisibly affixing cover plate 16' to support plate 14' may comprise a pair of metallic strips 74 disposed on the front surface of the support plate 14' and a pair of magnetic strips 76 disposed on the rear surface of the cover plate 16', as illustrated in FIG. 9. Additionally the metallic strips 74 may be disposed on the rear surface of the cover plate 16' and the magnetic strips 76 disposed on the front surface of the support plate 14'.

A wall mounted push button switch embodiment of the present invention will now be explained. Except as noted, the description of the slide dimmer embodiment is applicable to the wall mounted push button embodiment.

As illustrated in FIGS. 6 and 7, the wall mounted switch embodiment comprises a cover plate 16" and a support plate 14", as before. Generally centrally disposed in the support plate 14" is a first opening 20" which may be elongated, round, square, etc., as desired to accommodate the operating member 28" of a switch disposed adjacent the rear surface of the support plate 14". Generally centrally disposed in the cover plate 16" is a second substantially rectangular opening 18" which accomodates a push button 64. Push button 64 is maintained in the opening 18" by means of integral brackets 66 having resilient spring tabs 68 extending therefrom, as shown. The rear portion 65 of the push button 64 has a greater length and width than the length and width of the opening 18", while the length and width of the front portion 67 is slightly less than the length and width of the opening 18". Thus, a portion of the push button 64 protrudes through the opening 18", but the larger rear portion 65 is captured behind the cover plate 16" and prevents the push button 64 from falling through the front surface of the cover plate 16". The spring tabs 68 urge the push button 64 toward the front surface of the cover plate 16". Thus, the push button 64 is depressable when pressure is applied to the front surface thereof to depress the operating member 28" and thereby open and close the switch.

Alternatively, the operating member 28" may extend through both openings 18", 20" and a push button may be connected to the operating member 28" adjacent the front surface of the cover plate 16".

As before, the means for invisibly affixing the cover plate 16" to the support plate 14" comprises tabs 54" for engagement with rails 36". Alternatively, the means for invisibly affixing the cover plate 16 to support plate 14 could comprise magnetic strips 76 and metallic strips 74, as illustrated in FIG. 9.

FIG. 12 illustrates a known slide dimmer switch 100 having a cover plate 106, a slider 110 and a handle 102. The slider 110 is disposed between a pair of guide means 108 integrally disposed on the rear surface 107 of cover plate 106. An operating member 104 is associated with the slider and operates a linear potentiometer (not shown) operatively coupled to a voltage control means (also not shown). A pair of retaining means 112 are integral with and extend from the rear portion 107 of cover plate 106. The retaining means 112 permit the cover plate 106 to be snapped onto another plate associated with the dimmer switch.

It has been found that 8.33 amp capacity 1.5 A width, 11.67 amp capacity 2.5 A width and 12.5 amp capacity 2.5 A width low profile dimmer switches, of the type hereinbefore described, may be constructed to meet U.L. operating temperature standards. The following design considerations have been found to be relevant in contructing such dimmer switches to meet U.L. standards: triac selection (minimum forward voltage drop at maximum operating current); selection of wire diameter comprising the RFI choke that is common to most dimmer circuits; selection of lead wire diameter; lead dress; lead wire arrangement; and selection of type and size of heat transfer materials. FIGS. 19 through 24 illustrate various embodiments of the hereinbefore described low profile dimmer switches that incorporate these design considerations. The present invention is useful with any well-known dimmer circuitry, such as that schematically illustrated in FIG. 25. The present invention has particular application to dimmer circuits such as that shown in FIG. 25 that have a smooth and continuous dimming range up to at least 95% of full voltage.

Turning now to FIG. 19, there is illustrated one embodiment of a 8.33 amp capacity, 1.5 A low profile dimmer switch labeled generally 113. Dimmer switch 113 comprises a support plate 14 having a length l and a width w. Preferably the width of support plate 14 is 1.5 A and the length is no greater than 3 A. More particularly, it is preferred that the width w measure no greater than about $2\frac{3}{4}$ inches and the length l measure no greater than about $4\frac{1}{2}$ inches. It is also preferred that the support plate be constructed of aluminum and that its front surface be substantially flat (excepting rails 36), although, as mentioned, short septa not exceeding the height of upstanding portions 22 may be provided, if desired. In the preferred embodiment, the thickness of support plate 14 is approximately 0.055 inch and the overall surface area of support plate 14 measures approximately 26 square inches (including the area contributed by the upstanding portions 22). If dimmer 113 is a slide dimmer switch, as is illustrated in FIG. 18, then a cradle 114 may be riveted to the rear surface of support plate 14. Cradle 114 houses linear potentiometer 90 (see FIG. 8). A pair of lead wires 130, 132 is electrically connected to the load and supply sides of the dimmer circuit.

As shown, the dimmer circuit includes a choke 120 that is part of a RFI circuit. The choke 120 employed in the 8.33 amp capacity 1.5 A width low profile dimmer switch preferably has an inductance of 30 $\mu$H (nominal) and is constructed of twenty turns of AWG 14 magnet wire (nylon solvar polyurethane insulated) wound on a MSS iron powder core. The core preferably has an external diameter of approximately 0.9 inch and an internal diameter of approximately 0.55 inch. A suitable core is available from The Arnold Engineering Co., 300 West Street, Marengo, Ill. 60152, part number A4-12055. The choke should exhibit a rise time characteristic (di/dt) not exceeding 5 amps/$\mu$sec (1500 W load, 90° conduction angle, and 120 VAC source).

The circuitry of dimmer switch 113 comprises a triac 140 (with attached connecting lug) in thermal connection with support plate 14. More particularly, a small copper strip 144 is eyeleted to the rear surface of support plate 14 (a thermally conductive grease such as Dow Corning 340 Silicone Heat Sink Compound is first applied to the contacting surfaces of the copper strip and the aluminum support plate), one side of a beryllium oxide disk 142 is soldered to the copper strip 144 and the triac 140 is soldered to the other side of the beryllium oxide disk 142. Preferably, copper strip 144 measures about 1.23 inches by 0.54 inch and is approximately 0.062 inch thick. Triac 140 is preferably a triac having a 35 amp continuous current rating and a forward voltage drop of no greater than about 1.0 volt at 8.33 amps (the dimmer switch's maximum specified operating current), such as a Sanrex model SSG 35B30F.

In the 8.33 amp capacity 1.5 A septa dimmer switch hereinbefore described it is known to use AWG 16 lead wires. It has been found, however, that improved thermal performance is provided if AWG 12 stranded wire is utilized for lead wires 130, 132. The thermal performance of dimmer switch 113 is further improved by dressing the lead wires ("lead dress") in known fashion. Thus, the lead wires 130, 132 are preferably bent or curved in a substantially U shaped pattern as shown at 134, 135 in close vicinity to the dimmer circuitry. Preferably, the length of curve (e.g., the distance from 136 to 138 on wire 132) should be about 2.5 inches.

Figure 25:
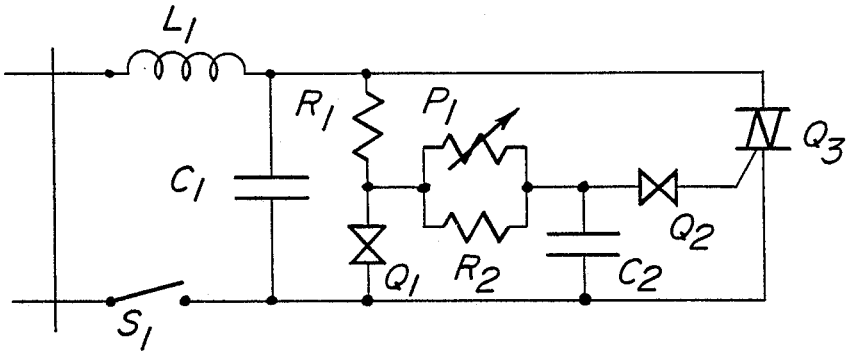
FIG. 25 is a schematic diagram of a dimmer circuit that may be used in the practice of the present invention.

Preferably, dimmer switch 113 has a continuous and smooth dimming range up to at least 95% of full voltage and the triac, and not a mechanical break switch, carries the full load current at all times when the dimmer switch is on. Dimmer circuits that provide such a dimming range are well known in the art. One such circuit is illustrated in FIG. 25. When dimmer switch 113 has been constructed as above described, it has been observed that when operating under maximum specified load conditions (8.33 amps at 120 VAC), the maximum temperature rise on field wiring terminals or on the conductors of lead wires 130, 132 is no greater than 30° C., the maximum temperature rise of any part of the dimmer switch that can contact field wiring is no greater than 35° C. and the maximum temperature rise of any other part of the dimmer switch that is exposed is no greater than 65° C. Thus, the thermal performance of dimmer 113 meets requirements specified by U.L.

Illustrated in FIG. 20 is another embodiment of a 8.33 amp capacity 1.5 A low profile dimmer switch according to the present invention and labeled generally 115. Dimmer switch 115 is identical in all respects to the dimmer switch 113 of FIG. 19 previously described except that dimmer switch 115 utilizes a large copper pad 146 instead of a small copper strip 144. Preferably, copper pad 146 measures approximately 2.8 inches by 1.7 inches and is about 0.063 inches thick. As shown, triac 140 and cradle 114 are both disposed over copper pad 146. As before, it is preferred that triac 140 have a 35 amp continuous current rating and a forward voltage drop of no greater than about 1.0 volts at 8.33 amps, such as provided by a Sanrex model SSG 35B30F triac.

Preferably, dimmer switch 115 has a continuous and smooth dimming range up to at least 95% of full voltage and the triac, and not a mechanical break switch, carries the full load current at all times when the dimmer switch is on. When dimmer switch 115 has been constructed as above described, it has been observed that when operating under maximum specified load conditions (8.33 amps at 120 VAC), the maximum temperature rise on field wiring terminals or on the conductors of lead wires 130, 132 is no greater than 30° C., the maximum temperature rise of any part of the dimmer switch that can contact the field wiring is no greater than 35° C. and the maximum temperature rise of any other exposed part of the dimmer switch is no greater than 65° C.

Turning now to FIG. 21, a 11.67 amp capacity 2.5 A low profile dimmer switch according to the present invention will be described. A 11.67 amp capacity 2.5 A dimmer switch 117 according to the present invention comprises a support plate 14 having a width w and length l. Unlike the support plate 14 of dimmers 113 and 115, the support plate 14 of dimmer 117 is preferably constructed of 0.062 inch thick copper to improve the dimmer switch's thermal performance. Additionally, it is preferred that the copper support plate be painted black or have a matt finish to further improve its ability to radiate heat.

In the preferred practice of the invention, the width w is about 2.5 A and the length l is about 2.5 A. Still further, it is preferred that the front surface of support plate 14 of dimmer 117 be substantially flat, although low septa may be provided, as before. It is also preferred that the width w measure about 4½ inches and that the length l measure no greater than about 4½ inches. The overall surface area of support plate 14, including that contributed by upstanding portions 22, preferably measures about 44 square inches.

As with dimmer switches 113 and 115, if dimmer switch 117 is a slide dimmer, as is the dimmer illustrated in FIG. 21, a cradle 114 is riveted to the rear surface of support plate 14. A copper pad 154 is interposed between the cradle 114 and support plate 14 as hereinafter described.

The dimmer circuitry associated with dimmer switch 117 includes a choke that is part of a RFI circuit. The choke 120 employed in the 11.67 amp capacity 2.5 A width low profile dimmer switch preferably has an inductance of 5 μH (nominal) and is contructed of eight pairs of spaced turns (for a total of sixteen turns) of AWG 14 magnet wire (nylon solvar polyurethane insulated) wound on an enamel coated MSS iron powder core. The core preferably has an external diameter of approximately 0.9 inch and an internal diameter of approximately 0.55 inch. A suitable core is available from The Arnold Engineering Co., 300 West Street, Marengo, Ill. 60152, part number A4-12055. The choke should exhibit a rise time characteristic (di/dt) not exceeding 6 amps/μsec (2000 W load, 90° conduction angle and 120 VAC source).

A triac 150 (with attached connecting lug) associated with the dimmer circuitry is in thermal connection with support plate 14. In particular, copper pad 154, preferably measuring about 2.8 inches by 1.7 inches and being about 0.063 inch thick, is riveted to the rear surface of the copper support plate 14 (a thermally conductive grease such as Dow Corning 340 Silicone Heat Sink Compound is applied to the mating surfaces of the copper pad and copper support plate). One side of a beryllium oxide disk 152 is soldered to the copper pad 154 while triac 150 is soldered to the other side of beryllium oxide disk 152. Use of the copper pad facilitates construction of the dimmer.

Preferably, triac 150 is a triac having a 35 amp continuous current rating and forward voltage drop of no greater than about 1.05 volts at 11.67 amps, such as a Sanrex model SSG 35B30F.

It has been observed that, in the operation of most dimmer switches, the following temperature relationship exists:

$$T_{LUG} > T_A > T_{LEAD}$$

where:

$T_{LUG}$ is the temperature of the hottest lug, e.g., lug 177 (FIG. 21), to which a lead wire is connected in the dimmer circuit;

$T_A$ is the ambient temperature within the housing 59 covering the dimmer circuit; and $T_{LEAD}$ is the temperature of the hottest conductor of the lead wires measured at the point where the lead wires exit the housing 59.

Since both $T_{LUG}$ and $T_A$ exceed $T_{LEAD}$, heat from the lugs and the housing interior is transferred to the lead wires within the housing 59. The lead wires thus serve to transfer heat away from the dimmer circuit and out of the housing. Unless precautionary measures are taken, $T_{LEAD}$ (max), i.e., the maximum temperature rise on the conductors of the lead wires measured at the point where the lead wires exit the housing, may exceed that specified by U.L. This is particularly true in a low profile 11.67 amp capacity 2.5 A non-septum dimmer switch. Conventional design methods cannot solve this problem. According to the invention, however, there is provided a novel lead wire arrangement for maintaining $T_{LEAD}$ (max) within U.L. specifications. Although described herein as for use with a 11.67 amp capacity 2.5 A low profile dimmer switch, this lead wire arrangement has application to any circuit where heat transfer to lead wires extending through a housing is a problem.

According to the invention, two parallel wires from each "hot junction" of the dimmer circuit are provided instead of a single wire from each "hot junction". (As used herein, the term "hot junction" refers to the lug or other portion of the dimmer circuit to which a lead wire is connected.) The wire sizes must be chosen so that they may safely carry full load and surge currents, but generally it may be stated that the diameter of each of the parallel wires should be smaller than that of a single wire having a diameter sufficient to carry the same full load and surge currents. For example, if a single AWG 10 stranded wire is required to carry full load current, this may be replaced by two parallel AWG 12 stranded wires or by two parallel AWG 14 stranded wires. The following unexpected and surprising result has been found. While the two parallel wires, e.g., AWG 12 or AWG 14, collectively have a greater heat transfer area ($\pi \cdot D_1 \cdot L \cdot 2$, where $D_1$ is the wire diameter and L is length of wire within the housing) than a single larger diameter wire ($\pi \cdot D_2 \cdot L$, where $D_2$ is the wire diameter of the larger wire) e.g., AWG 10, the temperature $T_{LEAD}$ (max) measured on any one of the wires in the parallel wire arrangement is less than that measured in the single wire arrangement. One would expect $T_{LEAD}$ (max) to be greater in the parallel wire arrangement, since it has greater heat transfer surface area, but this is not the case.

The advantages of this novel lead wire arrangement are numerous. For example, a dimmer circuit that generates more heat may still be constructed to meet U.L. specifications. Thus, less expensive and/or more effective RFI chokes may be used in the dimmer circuit. A less expensive triac with a higher forward voltage drop at a specified current may be used. Also, the power rating of the dimmer circuit may be increased without altering the size or profile of the support plate.

Application of the novel lead wire arrangement will now be explained in connection with the example of the 11.67 amp capacity 2.5 A low profile dimmer switch. As illustrated in FIG. 21, a pair AWG 12 stranded lead wires is connected in parallel to each side of the dimmer circuit. In particular, a pair of AWG 12 stranded lead wires 156, 158 is connected in parallel to a "hot junction" of the supply side of the dimmer circuit and a pair of lead wires 160, 162 is connected in parallel to a "hot junction" of load side of the dimmer circuit. In the embodiment illustrated in FIG. 21, lead wires 156, 158 are soldered together at 164 (preferably within the housing 59) and to an AWG 10 stranded wire 168 that extends through the housing 59 for connection to field wiring. Similarly, the pair of parallel lead wires 160, 162 are soldered together at 166 (again, preferably within the housing 59) and to an AWG 10 stranded wire 170 that extends through the housing 59 for connection to field wiring. It has been found that this arrangement reduces $T_{LEAD}$ (max) (measured on the AWG 10 stranded wires extending through the housing) by about 1°-2° C. over the use of only a single AWG 10 stranded wire directly connected to each hot junction.

According to another embodiment of the invention, wires 168, 170 are not provided, but instead wires 156, 158, 160 and 162 extend through the housing 59 for direct connection to field wiring. It has been found that this arrangement reduces $T_{LEAD}$ (max) (on each of the AWG 12 stranded wires extending through the housing) by about 3°-5° C. over the use of only a single AWG 10 stranded wire connected to each hot junction.

Experiments have also been performed with parallel AWG 14 stranded lead wires instead of parallel AWG 12 lead wires. Such experiments have shown that this arrangement can reduce $T_{LEAD}$ (max) by as much as 2° C. over the use of a single AWG 10 stranded wire connected to the hot junction.

As before, the lead wires 156, 158 160, 162 are preferably dressed by bending or curving into a generally U shaped pattern in the vicinity of the dimmer circuit, as shown at 178, 179. This lead dress further enhances the thermal performance of 117. Preferably, the length of curve, (e.g., the distance between points 176 and 178 of the lead wires 172, 174) is about 2.5 inches.

Preferably, dimmer switch 117 has a continuous and smooth dimming range up to at leat 95% of full voltage and the triac, and not a mechanical break switch, carries the full load current at all times when the dimmer switch is on. Dimmer circuits that provide such a dimming range are well known in the art. One such circuit is illustrated in FIG. 25. When dimmer switch 117 has been constructed as above described, it has been observed that when operating under maximum specified load conditions (as described 11.67 amps), the maximum temperature rise on field wiring terminals or on the conductors of the lead wires 156, 158, 160, 162, 168, 170, is no greater than 30° C., the maximum temperature rise of any part of the dimmer switch that can contact field wiring is no greater than 35° C. and the maximum temperature rise of any other part of the dimmer switch that is exposed is no greater than 65° C.

Figure 22:
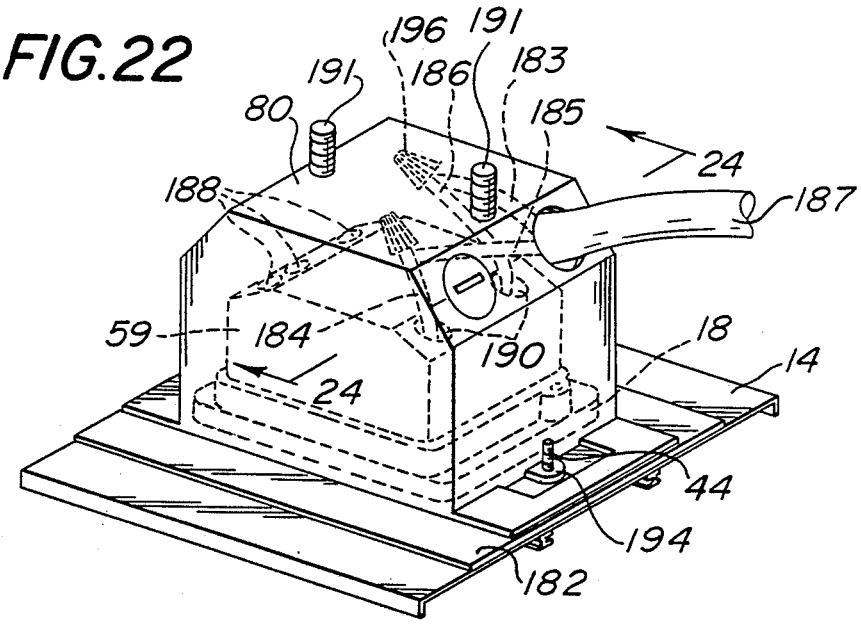
FIG. 22 is a perspective view of the rear side of a 12.5 amp capacity 2.5A width dimmer switch according to the present invention and illustrates in phantom the dimmer switch disposed in a wall box.
Figure 23:
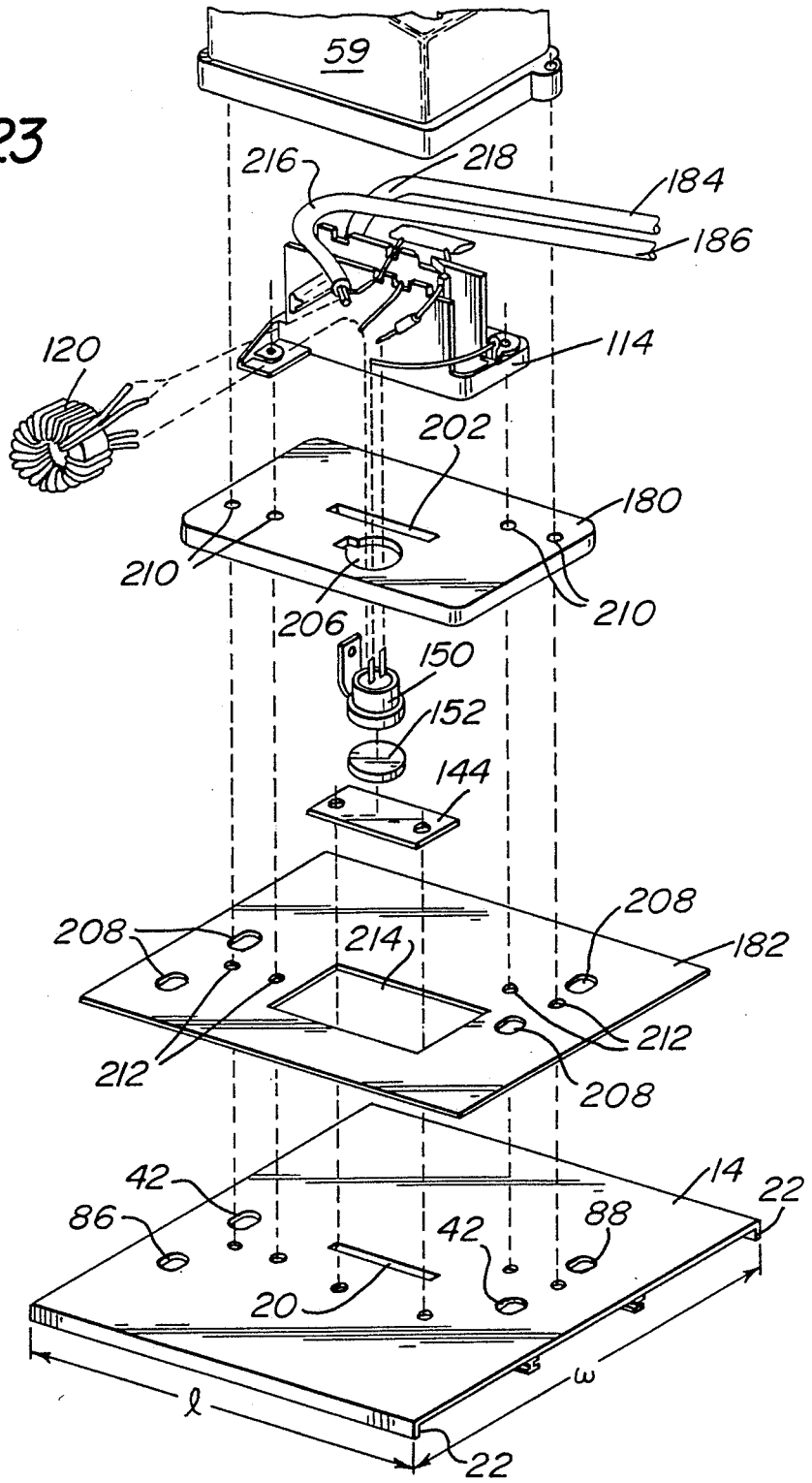
FIG. 23 is an exploded isometric view of the rear side of a 12.5 amp capacity 2.5A width non-septum dimmer switch according to the present invention.
Figure 24:
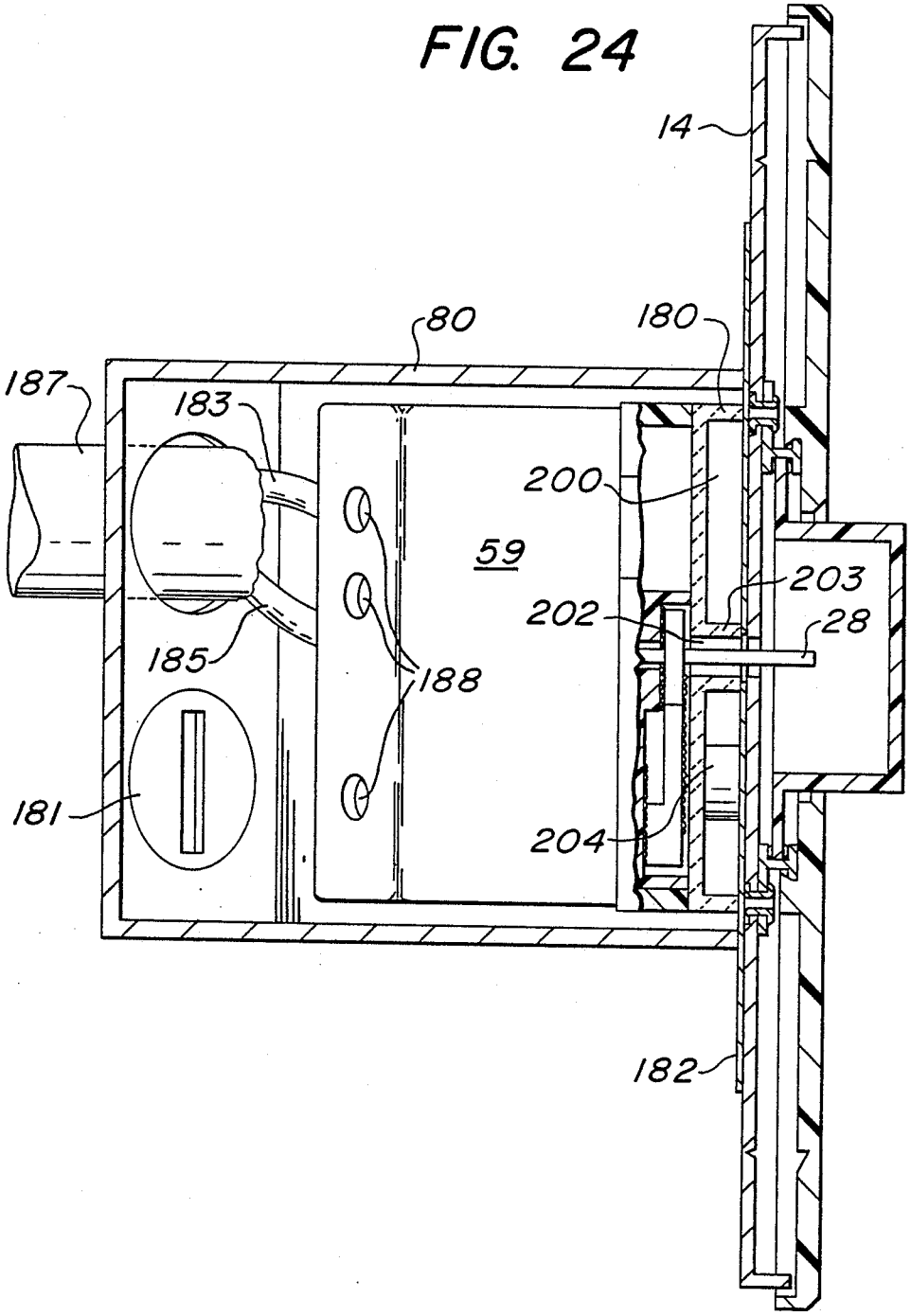
FIG. 24 is a cross section taken along lines 24—24 of FIG. 22.

Turning to now to FIGS. 22, 23 and 24, a 12.5 amp capacity 2.5 A width low profile dimmer switch according to the present invention will be described. Due to novel "thermal isolating" means utilized in the practice of the 12.5 amp capacity 2.5 A width dimmer switch described herein, the use of means such as a copper support plate, a large copper pad for triac mounting, and the four lead wire arrangement discussed in connection with the 11.67 amp capacity 2.5 A width dimmer switch is not required to meet U.L standards. It should be understood that, although described in connection with a 12.5 amp capacity 2.5 A width dimmer switch, the "thermal isolating" means described below has application to any wall mounted dimmer, switch or other circuit where temperature must be controlled.

A 12.5 amp capacity 2.5 A dimmer switch 119 according to the present invention comprises a support plate 14 having a width w and a length l. Preferably the width w is no greater than about 2.5 A and the length l is no greater than about 2.5 A. Still further, it is preferred that the front surface of support plate 14 of dimmer switch 119 be substantially flat, although low septa may be provided. It is also preferred that the width w measure no greater than about 4½ inches and that the length l measure no greater than about 4½ inches. The overall surface area of support plat 14, including that contributed by upstanding portion 22, preferably measures no greater than about 44 square inches. It is also preferred that the support plate be constructed of aluminum having a thickness of approximately 0.060 inch. Preferably, the support plate has a matt finish to improve its ability to radiate heat.

If dimmer switch 119 is a slide dimmer switch, as is the dimmer switch illustrated in FIG. 23, then a cradle 114 may be riveted to rear surface of support plate 14 (means 180 and 182 are interposed between the crade 114 and the rear surface of support plate 14 for reasons described hereinafter). A pair of AWG 10 lead wires 184, 186 is electrically connected to the load and supply sides of the dimmer circuit and are dressed in a substantially U-shaped pattern as shown at 216, 218. Preferably, the dimmer circuit has a continuous and smooth dimming range up to at least 95% of full voltage and the triac 150, and not a mechanical break switch, carries the full load current at all times when the dimmer switch is on. A dimmer circuit such as that illustrated in FIG. 25 may be used. As shown, the dimmer circuit includes a choke 120 that is part of a RFI circuit. The choke 120 employed in the 12.5 amp capacity 2.5 A width dimmer switch should be the same as that described in connection with the 11.67 amp capacity 2.5 A dimmer switch.

Triac 150 (and attached connecting lug) associated with the dimmer circuit is in thermal connection with support plate 14. In particular, copper strip 144, preferably measuring about 1.23 inches by 0.54 inch and being approximately 0.062 inch thick, is riveted to the rear surface of support plate 14 (a thermally conductive grease such as Dow Corning 340 Silicone Heat Sink Compound is applied to the mating surfaces of the copper strip 144 and support plate 14). One side of a beryllium oxide disk 152 is soldered to the copper strip 144 while triac 150 is soldered to the other side of beryllium oxide disk 152. Triac 150 is preferably a triac having a 35 amp continuous current rating and a forward voltage drop of no greater than about 1.05 volts at 12.5 amps, such as a Sanrex model SSG 35B30F.

As has been mentioned, support plate 14 is adapted to mount to a wall box 80 (see FIG. 22). Thus, screws 44 secure support plate 14 to wall box 80 by means of threaded ears 194. As is known, wall box 80 comprises knock-outs 181 that are removed when it is desired to insert field wiring into wall box 80. Thus, as illustrated in FIG. 22, field wiring 187, comprising conductors 183, 185, extends into wall box 80 for connection to lead wires 184, 186 of dimmer switch 119. Conductors 183, 185 are electrically coupled to the conductors of leadd wires 184, 186 by means of wire connectors 196, 198 in well known manner. As is also well known, wall box 80 comprises internal clamps (not shown) and associated screws 191 for securing field wiring 187 to the wall box 80.

As best shown in FIG. 22, housing 59 comprises a plurality of holes 188, 190. Three holes 188 are provided at one end of housing 59 while two holes 190 are provided at the other end of housing 59. The diameter of holes 188 is smaller than the diameter of holes 190.

Holes 190 are provided to accommodate the larger diameter AWG 10 wire. The smaller holes 188 are utilized in connection with the practice of the 8.33 amp 1.5 A dimmer switch wherein smaller diameter lead wires may be utilized.

It has been found that if the interior of housing 59 is thermally isolated from the support plate 14, and further if the wall box 80 is thermally isolated from the support plate 14, the maximum temperature of the conductors of lead wires 184, 186 will remain far within acceptable levels when the dimmer switch 119 is operating at or near its full load current of 12.5 amps. This is true even if the parallel lead wire arrangement previously described is not utilized. It is also true if an aluminum support plate rather than a copper support plate is utilized. Thus, the thermal isolation means described herein provides a simple and inexpensive means of producing a U.L. listed 12.5 amp capacity 2.5 A width low profile dimmer switch.

The thermal isolation means utilized in the practice of the present invention comprises a first means for thermally isolating the interior of housing 59 from the support plate 14 and a secondd means for thermally isolating the wall box 80 from the support plate 14. The first means comprises a thermal isolating means 180 disposed between the housing 59 and the rear surface of the support plate 14. Similarly, the second means comprises a thermal isolating means 182 disposed between wall box 80 and the rear surface of support plate 14.

Preferably, the first means 180 is constructed of a molded plastic such as Valox®420SEO as manufactured by General Electric Company, although any suitable high temperature plastic that has thermal insulating qualities will suffice. As best illustrated in FIG. 24, the plastic heat shield 180 is preferably hollow so as to provide an air gap 200 between the rear surface of the support plate 14 and the housing 59 (and its interior). It is believed that the air gap 200 provides increased thermal resistance. As shown in FIG. 23, the plastic heat shield 180 is interposed between the crade 114 and support plate 14. Cradle 114 and housing 59 are eyeleted to the support plate 14, through the plastic heat shield 180, by means of holes 210 provided in the plastic heat shield 180. Plastic heat shield 180 is also provided with a slot 202 that is in substantial alignment with the slot 20 in support plate 14 to permit sliding movement of the operating member 28. See FIGS. 23 and 24. Preferably, slot 202 is provided with shoulders 203. See FIG. 24. Similarly, it is preferred that holes 210 be provided with shoulders 204, as also illustrated in FIG. 24. Preferably, plastic heat shield 180 is provided with an opening 206 configured to accommodate triac 150.

As shown, the length and width of plastic shield 180 is only slightly larger than the corresponding length and width of housing 59 so as to prevent any part of housing 59 from coming into contact with support plate 14. Thus, housing 59 is completely thermally isolated from support plate 14 (except for the eyelets affixing housing 59 to support plate 14). In the preferred practice of the invention, the thickness of plastic heat shield 180 is about 0.22 inch.

The second thermal isolating means 182 preferably comprises a piece of fishpaper 182 such as Armite manufactured by Spaulding Fibre Company, Tonawanda, N.Y., disposed on the rear surface of support plate 14. The size and shape of the piece of fishpaper 182 is not critical—any size and/or shape will suffice provided that the fishpaper insulates all parts of the wall box from the support plate (except for the screws 44 affixing support plate 14 to wall box 80). The precise thickness is also not critical. Thicknesses of 0.015 inch to 0.030 inch have been found to provide satisfactory results. In the preferred practice of the invention, the piece of fishpaper 182 is rectangular in shape and is provided with four elongated holes 208 that are in substantial alignment with the mounting holes 42, 88 in support plate 14. Fishpaper 182 is also provided with holes 212 that are in alignment with holes 210 in the plastic heat shield 180. Still further, the fishpaper 182 is provided with an opening 214 that accommodates both the copper strip 144 and the operating member 28. See FIGS. 23 and 24. As shown, when the dimmer switch is fully constructed as hereinbefore described, the piece of fishpaper 182 is sandwiched between the support plate 14 and the plastic heat shield 180 and thus is secured to the dimmer switch 119 thereby.

When dimmer switch 119 has been constructed as abovedescribed, it has been observed that when operating under maximum specified load conditions (12.5 amps), the maximum temperature rise on field wiring terminals or on the conductors of the lead wires 184, 186 is no greater than 30° C., the maximum temperature rise of any part of the dimmer switch that can contact field wiring is no greater than 35° C. and the maximum temperature rise of any other part of the dimmer switch that is exposed is no greater than 65° C. Thus, the dimmer switch 119 meets UL operating temperature standards.

There has been described a novel low profile cover and support plate arrangement that has application to wall mounted dimmer switches, push button switches, wall mounted displays, etc. For use in connection with dimmer circuitry, there has also been described novel construction techniques for enhancing the thermal performance of the dimmer such that septa are no longer required to meet U.L. temperature performance standards.

The present invention may be embodied in other specific forms without departing from the spirit or essential attributes thereof and, accordingly, reference should be made to the appended claims, rather than to the foregoing specification, as indicating the scope of the invention.

We claim:

1. An apparatus comprising: a. a support plate adapted for mounting to a wall box embedded in a wall, the support plate having overall surface dimensions greater than the corresponding dimensions of the wall box and including a generally flat front and rear surface, the front surface having a pair of spaced upstanding portions disposed adjacent opposing vertical side edges thereof; b. a cover plate juxtaposed over the front surface of the support plate, spaced therefrom so as to provide an air gap between the rear surface of the cover plate and the front surface of the support plate and to provide a low profile with respect to the wall surface on which the support plate is to be mounted, the overall surface dimensions of the cover plate being greater the the corresponding dimensions of the support plate including first portions laterally extending beyond the vertical side edges of the support plate; c. an electric circuit having a heat generating controllably conductive device therein, the heat generating device thermally connected to the support plate and adapted to be connected in series with a controlled load and to be electrically coupled to field wiring from a power source provided to the wall box; and d. the front surface of the support plate, the rear surface of the cover plate and the pair of upstanding portions defining a chimney for the dissipation of heat generated by the controllably conductive device, the open opposing horizontal side edges of the support plate defining inlets and outlets of the chimney; whereby the laterally extending first portions of the cover plate cast shadows along vertical sides of the support plate such that the vertical sides of the support plate are visible only when viewed at extreme angles with respect to an imaginary line perpendicular to the plane of the support plate, thereby giving the appearance that the cover plate is floating from the wall.

2. Apparatus according to claim 1 wherein the distance between the rear surface of the support plate and the top of the upstanding portions is no greater than about 0.2 inches.

3. Apparatus according to claims 1 or 2 wherein the ratio of (a) the distance between the rear surface of the support plate and the rearmost surface of the cover plate to (b) the distance by which the first portions extend over the vertical side edges is less than approximately 2 to 1.

4. Apparatus according to claims 1 or 2 wherein the minimum extreme angle is 25°.

5. Apparatus according to claims 1 or 2 further comprising means for removably and invisibly affixing the cover plate to the support plate.

6. Apparatus according to claim 1 further comprising: a linear adjustable potentiometer for controlling the output of the circuit disposed adjacent the rear surface of the support plate, the support plate including a slot centrally disposed within its surface, the potentiometer having an operating member extending through and slidable along the slot in the support plate; and a handle connected to the operating member and accessible from a location adjacent the front surface of the cover plate to effect sliding movement of the operating member.

7. Apparatus according to claim 6 further comprising control means connected to the potentiometer and adapted for varying an output signal of the circuit according to the linear setting of the operating member.

8. Apparatus according to claim 7 further comprising an on-off switch and the operating member comprises means for opening the switch at one extreme end of its travel.

9. Apparatus according to claim 6 further comprising cam means mechanically coupled to the operating member adjacent the rear surface of the support plate, the cam means being disposed within a housing greased with a viscous lubricant so as to create a viscous damping of the sliding movement of the operating member.

10. Apparatus according to claim 9 further comprising control means coupled to the potentiometer and adapted for varying an output signal of the circuit according to the linear setting of the operating member.

11. Apparatus according to claim 10 further comprising an on-off switch and wherein the cam means slidingly contacts a member associated with the on-off switch to open the switch when the operating member has been slid to an extreme end of its travel.

12. Apparatus according to claim 6 further comprising a slider disposed between a pair of parallel spaced apart rails secured to one of the front surface of the support plate or the rear surface of the cover plate and engaging opposite sides of the slider, the handle being integral with the slider and extending through a slot in the cover plate.

13. Apparatus according to claim 12 wherein the rails are separate from each other and are separately formed from the support plate and cover plate.

14. Apparatus according to claim 12 wherein the support plate comprises a pair of mounting holes disposed beneath the path of travel of the slider, and in substantial alignment with a pair of threaded mounting holes in the wall box, there being a recessed portion around each mounting hole so as to define a counterbored mounting hole, each counterbored mounting hole receiving a mounting screw having a low profile pan head that seats in the recessed portion and is substantially flush with the front surface of the support plate, there being a small clearance between the screw heads and the slider.

15. Apparatus according to claim 14 wherein the clearance between the screw heads and the slider is approximately 0.025 inch.

16. Apparatus according to claim 15 wherein the distance between the front surface of the cover plate and the rear surface of the support plate is about 0.3 inch.

17. Apparatus according to claim 12 further comprising control means coupled to the potentiometer and adapted for varying an output signal of the circuit according to the linear setting of the operating member.

18. Apparatus according to claim 17 further comprising an on-off switch and wherein the operating member comprises means for opening the switch at one extreme end of its travel.

19. Apparatus according to claim 18 further comprising cam means coupled to the operating member adjacent the rear surface of the support plate, the cam means being disposed in a housing greased with a viscous lubricant so as to create a viscous damping of the sliding movement of the operating member.

20. Apparatus according to claim 15 further comprising a pair of parallel spaced apart rails secured to either the front surface of the support plate or the rear surface of the cover plate, and wherein the means for removably and invisibly affixing the cover plate to the support plate comprises a plurality of tabs disposed on the surface opposing the surface of rail securement and adapted to snap onto corresponding portions of the rails.

21. Apparatus according to claim 20 wherein the rails are separate from each other and are separately formed from the support plate and cover plate.

22. Apparatus according to claim 20 wherein the rails are secured to the front surface of the support plate and the tabs are disposed on the rear surface of the cover plate, each of the rails being secured to the support plate by a plurality of spaced eyelets, the tabs being in substantial alignment with the eyelets.

23. Apparatus according to claim 15 wherein the means for removably and invisibly affixing the cover plate to the support plate comprises a metal strip affixed to either the rear surface of the cover plate or front surface of the support plate and a magnetic strip affixed to the surface opposing the metal strip.

24. Apparatus according to claims 1 further comprising:

a. a generally centrally disposed first opening in the support plate and a corresponding generally centrally disposed second opening in the cover plate in substantial alignment with the first opening;

b. a rotary potentiometer disposed adjacent the rear surface of the support plate and having a rotatable operating member extending through at least the first opening;

c. a control knob connected to the operating member and being rotatable to cause a corresponding rotary movement of the operating member.

25. Apparatus according to claim 24 further comprising a control circuit coupled to the potentiometer, the control circuit adapted for varying the output signal of the circuit according to the rotary setting of the operating member.

26. Apparatus according to claims 1 further comprising:

a. a generally centrally disposed first opening in the support plate and a corresponding generally centrally disposed second opening in the cover plate in substantial alignment with the first opening;

b. a switch disposed adjacent the rear surface of the support plate and having a depressable operating member extending through at least the first opening;

c. a depressable button disposed adjacent the second opening and being operable, when depressed, to depress the operating member and thereby operate the switch.

27. Apparatus according to claim 1 wherein the controllably conductive means comprises a triac and wherein the triac is part of a dimmer circuit disposed adjacent the rear surface of the support plate.

28. Apparatus according to claim 27 wherein the dimmer circuit comprises at least one pair of lead wires adapted for connection to field wiring of the wall box and wherein all load current is carried by the triac for a dimming range up to at least 95% of full voltage that may be applied to the load.

29. Apparatus according to claim 28 wherein the dimensions of the support plate are related to the width A of the wall box, the support plate having a width no greater than about 1.5A and a length no greater than about 3A, the maximum temperature rise on field wiring terminals and on conductors of lead wires intended for field wiring being no greater than 30° C., the maximum temperature rise of any part of the apparatus that can contact the field wiring being no greater than 35° C., the maximum temperature rise of any other part of the apparatus that its exposed on the outside being no greater than 65° C. when the dimmer circuit is controlling loads that draw currents of up to 8.33 amps.

30. Apparatus according to claim 20 wherein the dimensions of the support plate correspond to the width A of the wall box, the support plate having a width no greater than about 2.5A and a length no greater than about 3A, the maximum temperature rise on field wiring terminals and on conductors of lead wires intended for field wiring being no greater than 30° C., the maximum temperature rise of any part of the apparatus that can contact field wiring being no greater than 35° C., the maximum temperature rise of any other part of the apparatus that is exposed on the outside being no greater than 65° C. when the dimmer circuit is controlling loads that draw currents of up to at least 11.67 amps.

31. Apparatus according to claim 28, wherein the dimensions of the support plate correspond to the width A of the wall box, the support plate having a width no greater than about 2.5A and a length no greater than about 3A, the maximum temperature rise on field wiring terminals and on conductors of lead wires intended for field wiring being no greater than 30° C., the maximum temperature rise of any part of the apparatus that can contact field wiring being no greater than 35° C., the maximum temperature rise of any other part of the apparatus that is exposed on the outside being no greater than 65° C. when the dimmer circuit is controlling loads that draw currents of up to at least 12.5 amps.

32. Apparatus according to claim 28 wherein the support plate has an overall surface area no greater than about 26 square inches, the maximum temperature rise on field wiring terminals and on conductors of lead wires intended for field wiring being no greater than 30° C., the maximum temperature rise of any part of the apparatus that can contact field wiring being no greater than 35° C., the maximum temperature rise of any other part of the apparatus that is exposed on the outside being no greater than 65° C. when the dimmer circuit is controlling loads that draw currents of up to 8.33 amps.

33. Apparatus according to claim 20 wherein the support plate has an overall surface area no greater than about 44 square inches, the maximum temperature rise on field wiring terminals and on conductors of lead wires intended for field wiring being no greater than 30° C., the maximum temperature rise of any part of the apparatus that can contact field wiring being no greater than 35° C., the maximum temperature rise of any other part of the apparatus that is exposed on the outside being no greater than 65° C. when the dimmer circuit is controlling loads that draw currents of up to at least 11.67 amps.

34. Apparatus according to claim 20 wherein the support plate has an overall surface area no greater than about 44 square inches, the maximum temperature rise on field wiring terminals and on conductors of lead wires intended for field wiring being no greater than 30° C., the maximum temperature rise of any part of the apparatus that can contact field wiring being no greater than 35° C., the maximum temperature rise of any other part of the apparatus that is exposed on the outside being no greater than 65° C. when the dimmer circuit is controlling loads that draw currents of up to 12.5 amps.

35. Apparatus according to claim 29 wherrein the triac has a forward voltage drop of no greater than about 1 volt at a forward current of about 8.33 amps.

36. Apparatus according to claim 32 wherein the triac has a forward voltage drop of no greater than about 1 volt at a forward current of about 8.33 amps.

37. Apparatus according to claim 30 wherein the triac has a forward voltage drop of no greater than about 1.05 volts at a forward current of about 11.67 amps.

38. Apparatus according to claim 31 wherein the triac has a forward voltage drop of no greater than about 1.05 volts at a forward current of about 12.5 amps.

39. Apparatus according to claim 33 wherein the triac has a forward voltage drop of no greater than about 1.05 volts at a forward current of about 11.67 amps.

40. Apparatus according to claim 34 wherein the triac has a forward voltage drop of no greater than about 1.05 volts at a forward current of about 12.5 amps.

41. Apparatus according to claim 29 wherein the support plate measures no greater than about 2¾ inches in width and 4½ inches in length.

42. Apparatus according to claim 30 wherein the support plate measures no greater than about 4½ inches square.

43. Apparatus according to claim 31 wherein the support plate measures no greater than about 4½ inches square.

44. Apparatus according to claim 29 wherein the support plate is aluminum, the lead wires are AWG 12 wire and the triac is disposed over an in thermal connection with a piece of copper that is in thermal connection with the support plate, there being a beryllium oxide disk interposed between the triac and the piece of copper, at least one of the lead wires being dressed in a substantially U-shaped pattern in the vicinity of the dimmer circuitry.

45. Apparatus according to claim 32 wherein the support plate is aluminum, the lead wires are AWG 12 wire and the triac is disposed over an in thermal connection with a piece of copper that is in thermal connection with the support plate, there being a beryllium oxide disk interposed between the triac and the piece of copper, at least one of the lead wires being dressed in a substantially U-shaped pattern in the vicinity of the dimmer circuitry.

46. Apparatus according to claim 44 wherein the piece of copper is a copper strip measuring about 1.23 inches by 0.54 inch.

47. Apparatus according to claim 44 wherein the piece of copper is a copper pad measuring about 2.8 inches by 1.7 inches.

48. Apparatus according to claim 45 wherein the piece of copper is a copper strip measuring about 1.23 inches by 0.54 inch.

49. Apparatus according to claim 45 wherein the piece of copper is a copper pad measuring about 2.8 inches by 1.7 inches.

50. Apparatus according to claim 30 wherein the support plate is copper, the lead wires comprise a pair of parallel AWG 12 to AWG 14 wires electrically connected to one hot junctionof the dimmer circuit and a pair of parallel AWG 12 to AWG 14 wires electrically connected to another hot junction of the dimmer circuit, and wherein the triac is in thermal connection with a copper pad that is in thermal connection with the support plate, there being a beryllium oxide disk interposed between the triac and the copper pad, at least one of the pair of parallel wires being dressed in a substantially U-shaped pattern in the vicinity of the dimmer circuit.

51. Apparatus according to claim 31 wherein the support plate is aluminum, the lead wires are AWG 10 wire and the triac is in thermal connection with a copper strip that is in thermal connection with the support plate, there being a berrylium oxide disk interposed between the triac and the copper strip, at least one of the wires being dressed in a substantially U-shaped pattern in the vicinity of the dimmer circuitry.

52. Apparatus according to claim 31 further comprising a housing disposed adjacent the rear surface of the support plate and covering the dimmer circuit, a first means thermally isolating the interior of the housing from the support plate and a second means thermally isolating the wall box from the support plate.

53. Apparatus according to claim 52 wherein the first means comprises a plastic shield and the second means comprises a piece of fishpaper.

54. Apparatus according to claim 33 wherein the support plate is copper, the lead wires comprise a pair of parallel AWG 12 to AWG 14 wires electrically connected to one hot junctionof the dimmer circuit and a pair of parallel AWG 12 to AWG 14 wires electrically connected to another hot junction of the dimmer circuit, and wherein the triac is in thermal connection with a copper pad that is in thermal connection with the support plate, there being a beryllium oxide disk interposed between the triac and the copper pad, at least one of the pair of parallel wires being dressed in a substantially U-shaped pattern in the vicinity of the dimmer circuit.

55. Apparatus according to claim 34 wherein the support plate is aluminum, the lead wires are AWG 10 wire and the triac is in thermal connection with a copper strip that is in thermal connection with the support plate, there being a berrylium oxide disk interposed between the triac and the copper strip, at least one of the wires being dressed in a substantially U-shaped pattern in the vicinity of the dimmer circuitry.

56. Apparatus according to claim 34 further comprising a housing disposed adjacent the rear surface of the support plate and covering the dimmer circuit, a first means thermally isolating the interior of the housing from the support plate and a second means thermally isolating the wall box from the support plate.

57. Apparatus according to claim 56 wherein the first means comprises a plastic shield and the second means comprises a piece of fishpaper.

58. Apparatus according to claim 50 wherein the copper pad measures about 2.8 inches by 1.7 inches.

59. Apparatus according to claim 51 wherein the copper strip measures about 1.23 inches by 0.54 inch.

60. Apparatus according to claim 56 wherein the copper pad measures about 2.8 inches by 1.7 inches.

61. Apparatus according to claim 55 wherein the copper strip measures about 1.23 inches by 0.54 inch.

62. Apparatus according to claim 58 wherein the support plate has substantially flat front and rear surfaces.

63. Apparatus according to claim 58 wherein the support plate comprises a pair of mounting holes in substantial alignment with threaded mounting holes in a wall box to which the support plate is to be mounted, the mounting holes being disposed beneath the path of travel of the slider, each mounting hole being surrounded by a recessed portion thereby defining a counterbored mounting hole, each counterbored mounting hole receiving a mounting screw having a low profile pan head that seats in the recessed portion and is substantially flush with the front surface of the support plate, there being a small clearance between the slider and the screw heads.

64. Apparatus according to claim 58 wherein the clearance between the actuator and the screw heads is no greater than 0.025 inch.

65. Apparatus comprising:

a. a support plate having front and rear surfaces;

b. a cover plate juxtaposed over the support plate and having front and rear surfaces;

c. a pair of separate parallel spaced apart rails secured to one of the front surface of the support plate or the rear surface of the cover plate and being separately formed from the cover plate and support plate; and d. an actuator having at least a portion sandwiched between the cover plate and the support plate and disposed between the rails for operating a control means disposed adjacent the rear surface of the support plate.

66. Apparatus according to claim 65 further comprising means disposed on the surface opposing the rails and adapted to cooperate with the rails for removably and invisibly affixing the cover plate to the support plate.

67. Apparatus according to claim 66 wherein the means for removably and invisibly affixing the cover plate to the support plate comprises a plurality of tabs adapted to snap onto corresponding portions of the rails.

68. Apparatus according to claim 67 wherein the rails are secured to the front surface of the support plate by a plurality of spaced eyelets and the tabs are disposed on the rear surface of the cover plate, the tabs being in substantial alignment with the eyelets.

69. Apparatus according to claim 65 wherein the rails extend the length of the support plate and overhang horizontal edges of the support plate, the overhanging portions of the rails cooperating with outwardly extending horizontal portions of the cover plate and maintaining the cover plate in substantial vertical alignment with the support plate.

70. Apparatus according to claim 65 wherein the height of each of the parallel spaced apart rails is no greater than about 0.15 inches.

71. Apparatus according to claim 65 wherein the distance between the rear surface of the support plate and the front surface of the cover plate is no greater than about 0.3 inch.

72. Apparatus according to claim 65 wherein the rails are constructed of aluminum.

73. Apparatus according to claim 65 wherein the rails are constructed of nylon.

74. Apparatus according to claim 65 wherein the control means comprises a linearly adjustable potentiometer disposed adjacent the rear surface of the support plate and having an operating member extending through and slidable along a slot in the support plate, the actuator comprising a slider connected to the operating member and having a handle accessible from a location adjacent the front surface of the plate to effect sliding movement of the sliding member, the control means varying an output signal of the circuit according to the linear setting of the operating member.

75. Apparatus according to claim 74 further comprising an on-off switch and wherein the operating member comprises means for opening the switch at one extreme end of its travel.

76. Apparatus according to claim 74 further comprising cam means coupled to the operating member adjacent the rear surface of the support plate, the cam means disposed within a housing and greased with a viscous lubricant adapted to create a viscous damping of the sliding movement of the operating member.

77. Apparatus according to claim 76 further comprising an on-off switch and wherein the cam means slidingly contacts a member associated with the on-off switch to open the switch when the operating member has been slid to an extreme end of its travel.

78. Apparatus according to claim 65 wherein the actuator comprises a control knob, and further comprising a generally centrally disposed first opening in the support plate and a corresponding generally centrally disposed second opening in the cover plate in substantial alignment with the first opening, the control means comprising a rotary potentiometer disposed adjacent the rear surface of the support plate and having a rotatable member extending through at least the first opening, the control knob connected to the operating member and adapted to be rotatable to cause a corresponding rotary movement of the operating member, the control means varying the output signal of the circuit according to the rotary setting of the operating member.

79. Apparatus according to claim 65 wherein the actuator comprises a depressable button, further comprising a generally centrally disposed first opening in the support plate and a corresponding generally centrally disposed second opening in the cover plate in substantial alignment with the first opening, and further wherein the control means comprises a switch disposed adjacent the rear surface of the support plate and having a depressable operating member extending through at least the first opening, the depressable button being disposed within the second opening and being operable, when depressed, to depress the operating member and thereby operate the switch.

80. Low profile wall switch apparatus comprising:

a. a support plate having front and rear surfaces and a pair of mounting holes at upper and lower ends thereof for mounting to a wall box embedded in a wall, the mounting holes each being surrounded by a recessed region on the front surface of the support plate so as to provide counterbored portions, the mounting holes each accepting a mounting screw, the screw heads seating in the counterbored portions and being substantially flush with the front surface of the support plate;

b. a cover plate juxtaposed over the front surface of the support plate and having front and rear surfaces; and c. an actuator having at least a portion sandwiched between the cover plate and the support plate and adapted to actuate a control circuit disposed adjacent the rear surface of the support plate, the actuator being moveable between first and second positions to set the control circuit, the mounting holes being disposed beneath the path of travel of the actuator but the counterbored portions preventing the screw heads from interfering with the movement of the actuator.

81. Apparatus according to claim 80 further comprising means for invisibly affixing the cover plate to the support plate.

82. Apparatus according to claim 80 wherein the distance between the front surface of the support plate and the rear surface of the cover plate is no greater than about 0.15 inch.

83. Apparatus according to claim 80 wherein the distance between the front surface of the cover plate and the rear surface of the support plate is no greater than about 0.3 inch.

84. Apparatus according to claim 81 further comprising a pair of separate parallel space apart rails affixed to either the front surface of the support plate or the rear surface of the cover plate and wherein the means for invisibly affixing the cover plate to the support plate comprises a plurality of tabs disposed on the surface opposing the surface to which the rails are affixed and adapted to snap onto corresponding portions of the rails.

85. Apparatus according to claim 84 wherein the rails are secured to the front surface of the support plate by a plurality of spaced eyelets and the tabs are disposed on the rear surface of the cover plate, the tabs being in substantial alignment with the eyelets.

86. Apparatus according to claim 84 wherein the rails extend the length of the support plate and overhang horizontal edges of the support plate, the overhanging portions of the rails cooperating with outwardly extending horizontal portions of the cover plate and maintaining the cover plate in substantial vertical alignment with the support plate.

87. Apparatus according to claim 84 wherein the actuator is a slider disposed between the rails for sliding motion therealong and the clearance between the slider and the screw heads is no greater than about 0.025 inch.

88. Apparatus according to claim 84 wherein the rails are separately formed from the support plate and cover plate.

89. Apparatus according to claim 88 wherein the rails are constructed of aluminum.

90. Apparatus according to claim 88 wherein the rails are constructed of nylon.

91. Apparatus according to claim 81 wherein the control circuit comprises a linearly adjustable potentiometer disposed adjacent the rear surface of the support plate and having an operating member extending through and slidable along a slot in the support plate, the slider including a handle connected to the operating member and accessible from a location adjacent the front surface of the cover plate to effect sliding movement of the operating member.

92. Apparatus according to claim 91 further comprising an on-off switch and wherein the operating member comprises means for opening the switch when the slider has been moved to its first position.

93. Apparatus according to claim 91 further comprising cam means coupled to the operating member adjacent the rear surface of the support plate, the cam means disposed within a housing and greased with a viscous lubricant adapted to create a viscous damping of the sliding movement of the operating member.

94. Apparatus according to claim 93 further comprising an on-off switch and wherein the cam means slidingly contacts a member associated with the on-off switch to open the switch when the slider has been moved to its first position.

95. Apparatus according to claim 80 wherein the front surface of the support plate is substantially flat and further comprises a pair of spaced upstanding portions disposed along adjacent opposing vertical side edges of the support plate and extending outwardly therefrom, and the cover plate having first portions that extend laterally over the vertical side edges of the support plate such that the first portions cast a shadow along vertical sides of the support plate and the vertical sides are visible only when viewed at extreme angles with respect to an imaginary line perpendicular to the plane of the support plate, thereby giving the appearance that the cover plate is floating from the wall.

96. Apparatus according to claim 95 wherein the cover plate is spaced from the front surface of the support plate so as to provide an air gap between the cover plate and support plate, there being inlets to and outlets from the air gap along opposed horizontal side edges of the support plate, the combination of the air gap, pair of upstanding portions and inlets and outlets defining a chimney through which air currents may flow.

97. Apparatus according to claim 95 further comprising a heat generating, controllably conductive device in thermal connection with the support plate and in series with a controlled load, the support plate dissipating heat generated by the controllably conductive device.

98. Apparatus according to claim 95 wherein the ratio of (a) the distance between the rear surface of the support plate and the rearmost surface of the cover plate to (b) the distance by which the first portions extend over the vertical side edges is less than approximately 2 to 1.

99. Apparatus according to claim 95 wherein the minimum extreme angle is 25°.

100. Wall switch apparatus comprising:

a. a support plate having front and rear surfaces for mounting to a wall box embedded in a wall;

b. a cover plate positioned over the front surface of the support plate;

c. a linearly moveable actuator slidable between first and second positions to set a control circuit disposed adjacent the rear surface of the support plate;

d. cam means disposed in a housing adjacent the rear surface of the support plate and operatively coupled to the actuator for linear movement therewith, the housing being greased with a viscous lubricant so as to provide a viscous damping of the sliding movement of the actuator.

101. Apparatus according to claim 100 further comprising a pair of separate rails disposed on one of the front surface of the support plate or the rear surface of the cover plate and wherein the actuator comprises a slider disposed between the rails for sliding movement therealong.

102. Apparatus according to claim 100 wherein the control circuit comprises a linearly adjustable potentiometer disposed adjacent the rear surface of the support plate and having an operating member extending through and slidable along a slot in the support plate, the actuator comprising a handle connected to the operating member and accessible from a location adjacent the front surface of the cover plate to effect sliding movement of the operating member.

103. Apparatus according to claim 102 further comprising an on-off switch and wherein the operating member comprises means for opening the switch when the actuator has been moved to the first position.

104. Apparatus according to claim 103 wherein the cam means slidingly contacts a member associated with the on-off switch to open the switch.

105. Apparatus according to claim 101 wherein the rails are separately formed from and are attached to one of the front surface of the support plate or rear surface of the cover plate.

106. Apparatus according to claim 105 wherein the rails are constructed of aluminum.

107. Apparatus according to claim 106 wherein the rails are constructed of nylon.

108. Apparatus according to claim 105 further comprising means for invisibly affixing the cover plate to the support plate.

109. Apparatus according to claim 108 wherein the means for invisibly affixing the cover plate to the support plate comprises a plurality of tabs disposed on one of the front surface of the support plate or rear surface of the cover plate and adapted to snap onto corresponding portions of the rails.

110. Apparatus according to claim 109 wherein the rails are attached to the front surface of the support plate by a plurality of spaced eyelets and the tabs are disposed on the rear surface of the cover plate in substantial alignment with the eyelets.

111. Apparatus according to claim 101 wherein the support plate further comprises a pair of counterbored mounting holes disposed beneath the path of travel of the slider, each mounting hole accepting a low profile pan head mounting screw, the screw head being substantially flush with the front surface of the support plate when fully inserted through the mounting hole, there being a small clearance between the screw heads and the slider.

112. Apparatus according to claim 111 wherein the clearance between the screw heads and the slider is no greater than about 0.025 inch.

113. Apparatus according to claim 111 wherein the distance between the rear surface of the support plate and the front surface of the cover plate is no greater than about 0.3 inch.

114. Apparatus according to claim 100 wherein the cover plate has first portions that overlay vertical side edges of the support plate and cast a shadow along vertical sides of the support plate so as to give the appearance that the cover plate is floating from the wall when viewed within extreme angles of view of an imaginary line perpendicular to the plane of the support plate.

115. Apparatus according to claim 114 wherein the maximum extreme angle is 25°.

116. Apparatus according to claim 114 wherein the ratio of (a) the distance between the rear surface of the support plate and the rearmost surface of the cover plate to (b) the distance by which the first portions extend over the vertical side edges is less than approximately 2 to 1.

117. Apparatus comprising:

a. a generally rectangular metal support plate for mounting to a wall box embedded in a wall and having overall surface dimensions greater than corresponding dimensions of the wall box, a generally flat rear surface, and a front surface having a pair of upstanding portions disposed along opposing vertical side edges of the support plate and extending generally perpendicularly outward therefrom;

b. a general rectangular cover plate juxtaposed over the front surface of the support plate and having front and rear surfaces, overall surface dimensions greater than corresponding dimensions of the support plate including first portions that extend over the upstanding portions of the support plate, the ratio of (i) the distance between the rear surface of the support plate and the rearmost surface of the cover plate to (ii) the distance by which the first portions extend over the upstanding portions being less than approximtely two to one, the rear surface of the cover plate being spaced from the front surface of the support plate by a distance no greater than about 0.15 inches so as to provide an air gap therebetween, the first portions casting a shadow along the vertical sides of the support plate, the vertical sides being visible only when viewed at an angle greater than 25° with respect to an imaginary line perpendicular to the plane of the support plate, thereby giving the appearance that the cover plate is floating from the wall;

c. a chimney between the support plate and the cover plate through which air currents may flow and being defined by the combination of the pair of upstanding portions, the air gap and open opposing horizontal side edges of the support plate defining inlets and outlets of the chimney;

d. a pair of separate parallel spaced apart rails separately formed from and affixed to the front surface of the support plate on opposite sides of a generally centrally disposed elongated slot by a plurality of spaced eyelets;

e. a linearly adjustable potentiometer disposed adjacent the rear surface of the support plate and having an operating member extending through and being slidable along the slot;

f. a slider connected to the operating member and being disposed between and supported by the rails and having a handle protruding into a generally centrally disposed elongated opening in the cover plate, there being a clearance between the slider and the front surface of the support plate of no greater than about 0.045 inch, the slider being slidably moveable to cause a corresponding sliding movement of the operating member;

g. voltage control means operatively connected to the potentiometer for varying an output voltage according to the linear setting of the slider, including a triac in thermal connection with the support plate;

h. cam means operatively connected to the operating member adjacent the rear surface of the support plate, the cam means being disposed within a housing greased with a viscous lubricant so as to create a viscous damping of the sliding movement of the operating member;

i. an on-off switch, the cam slidingly contacting a member associated with the on-off switch and opening the switch when the operating member has been slid to an extreme end of its travel;

j. a plurality of tabs disposed on he rear surface of the cover plate and being adapted to snap onto corresponding portions of the rails and being in substantial alignment with the eyelets; and k. a pair of horizontally elongated mounting holes disposed at upper and lower ends of the support plate and beneath the path of travel of the slider, the mounting holes each being surrounded by a recessed region on the front surface of the support plate so as to provide counterbored portions, the mounting holes each accepting a mounting screw, the screw heads seating in the counterbored portions and being substantially flush with the front surface of the support plate so as to prevent interference with the sliding motion of the slider.

118. Apparatus comprising:

a. a generally rectangular metal support plate for mounting to a wall box embedded in a wall and having overall surface dimensions greater than corresponding dimensions of the wall box, a generally flat rear surface, and a front surface having a pair of upstanding portions disposed along opposing vertical side edges of the support plate and extending generally perpendicularly outward therefrom;

b. a generally rectangular cover plate juxtaposed over the front surface of the support plate and having front and rear surfaces, overall surface dimensions greater than corresponding dimensions of the support plate including first portions that extend over the upstanding portions of the support plate, the ratio of (i) the distance between the rear surface of the support plate and the rearmost surface of the cover plate to (ii) the distance by which the first portions extend over the upstanding portions being less than approximately two to one, the rear surface of the cover plate being spaced from the front surface of the support plate by a distance no greater than about 0.15 inch so as to provide an air gap therebetween, the first portions casting a shadow along the vertical sides of the support plate, the vertical sides of the support plate being visible only when viewed at an angle greater than 25° with respect to an imaginary line perpendicular to the plane of the support plate, thereby giving the appearance that the cover plate is floating from the wall;

c. a chimney between the support plate and the cover plate through which air currents may flow and being defined by the combination of the pair of upstanding portions, the air gap and open opposing horizontal side edges of the support plate defining inlets and outlets of the chimney;

d. means for removably and invisibly affixing the cover plate to the support plate;

e. a generally centrally disposed first opening in the support plate and a corresponding generally centrally disposed second opening in the cover plate in substantial alignment with the first opening;

f. a rotary potentiometer disposed adjacent the rear surface of the support plate and having a rotatable operating member extending through the first opening;

g. a control knob having at least a portion sandwiched between the cover plate and the support plate, the control knob being connected to the operating member and protruding through the second opening and being rotatable to cause a corresponding rotary movement of the operating member; and h. a voltage control means operatively coupled to the potentiometer for varying an output voltage according to the rotary setting of the control knob, including a triac in thermal connection with the support plate.

119. Apparatus according to claims 117 or 118 wherein the voltage control means is a dimmer circuit.

120. Apparatus according to claim 119 wherein the dimmer circuit comprises at least a pair of lead wires for connection to field wiring and all load current is carried by the triac for a dimming range up to at least 95% of full voltage that may be applied to a load.

121. Apparatus according to claim 119 wherein the front surface of the support plate is substantially flat, the wall box has a width A, and the support plate has a width no greater than about 1.5A and a length no greater than about 3A, the maximum temperature rise on field wiring terminals and on conductors of lead wires intended for field wiring being no greater than 30° C., the maximum temperature rise of any part of the apparatus that can contact field wiring being no greater than 35° C., the maximum temperature rise of any other part of the apparatus that is exposed on the outside being no greater than 65° C. when the dimmer circuit is controlling loads that draw currents of up to 8.33 amps.

122. Apparatus according to claims 119 wherein the front surface of the support plate is substantially flat, the wall box has a width A, and the support plate has a width no greater than about 2.5A and a length no greater than about 3A, the maximum temperature rise on field wiring terminals and on conductors of lead wires intended for field wiring being no greater than 30° C., the maximum temperature rise of any part of the apparatus that can contact field wiring being no greater than 35° C., the maximum temperature rise of any other part of the apparatus that is exposed on the outside being no greater than 65° C. when the dimmer circuit is controlling loads that draw currents of up to at least 11.67 amps.

123. Apparatus according to claim 119 wherein the front surface of the support plate is substantially flat, the wall box has a width A, and the support plate has a width no greater than about 2.5A and a length no greater than about 3A, the maximum temperature rise on field wiring terminals and on conductors of lead wires intended for field wiring being no greater than 30° C., the maximum temperature rise of any part of the apparatus that can contact field wiring being no greater than 35° C., the maximum temperature rise of any other part of the apparatus that is exposed on the outside being no greater than 65° C. when the dimmer circuit is controlling loads that draw currents of up to 12.5 amps.

124. Apparatus according to claim 119 wherein the support plate has an overall surface area no greater than about 26 square inches, the maximum temperature rise on field wiring terminals and on conductors of lead wires intended for field wiring being no greater than 30° C., the maximum temperature rise of any part of the apparatus that can contact field wiring being no greater than 35° C., the maximum temperature rise of any other part of the apparatus that is exposed on the outside being no greater than 65° C. when the dimmer circuit is controlling loads that draw currents of up to 8.33 amps.

125. Apparatus according to claim 119 wherein the support plate has an overall surface area no greater than about 44 square inches, the maximum temperature rise on field wiring terminals and on conductors of lead wires intended for field wiring being no greater than 30° C., the maximum temperature rise of any part of the apparatus that can contact field wiring being no greater than 35° C., the maximum temperature rise of any other part of the apparatus that is exposed on the outside being no greater than 65° C. when the dimmer circuit is controlling loads that draw currents up to at least 11.67 amps.

126. Apparatus according to claim 119 wherein the support plate has an overall surface area no greater than about 44 square inches, the maximum temperature rise on field wiring terminals and on conductors of lead wires intended for field wiring being no greater than 30° C., the maximum temperature rise of any part of the apparatus that can contact field wiring being no greater than 35° C., the maximum temperature rise of any other part of the apparatus that is exposed on the outside being no greater than 65° C. when the dimmer circuit is controlling loads that draw currents up to 12.5 amps.

127. Apparatus according to claim 121 wherein the triac has a forward voltage drop of no greater than about 1 volt at a forward current of about 8.33 amps.

128. Apparatus according to claim 124 wherein the triac has a forward voltage drop of no greater than about 1 volt at a forward current of about 8.33 amps.

129. Apparatus according to claim 122 wherein the triac has a forward voltage drop of no greater than about 1.05 volts at a forward current of about 11.67 amps.

130. Apparatus according to claim 123 wherein the triac has a forward voltage drop of no greater than about 1.05 volts at a forward current of about 12.5 amps.

131. Apparatus according to claim 125 wherein the triac has a forward voltage drop of no greater than about 1.05 volts at a forward current of about 11.67 amps.

132. Apparatus according to claim 126 wherein the triac has a forward voltage drop of no greater than about 1.05 volts at a forward current of about 12.5 amps.

133. Apparatus according to claim 121 wherein the support plate measures no greater than about 2¾ inches in width and 4½ inches in length.

134. Apparatus according to claim 122 wherein the support plate measures no greater than about 4½ inches square.

135. Apparatus according to claim 123 wherein the support plate measures no greater than about 4½ inches square.

136. Apparatus according to claim 121 wherein the support plate is aluminum, the lead wires are AWG 12 wires and the triac is disposed over and in thermal connection with a piece of copper that is in thermal connection with the support plate, there being a beryllium oxide disk interposed between the triac and the piece of copper, at least one of the lead wires being dressed in a substantially U-shaped pattern in the vicinity of the dimmer circuitry.

137. Apparatus according to claim 124 wherein the support plate is aluminum, the lead wires are AWG 12 wire and the triac is disposed over and in thermal connection with a piece of copper that is in thermal connection with the support plate, there being a beryllium oxide disk interposed between the triac and the piece of copper, at least one of the lead wires being dressed in a substantially U-shaped pattern in the vicinity of the dimmer circuitry.

138. Apparatus according to claim 136 wherein the piece of copper is a copper strip measuring about 1.23 inches by 0.54 inch.

139. Apparatus according to claim 137 wherein the piece of copper is a copper strip measuring about 1.23 inches by 0.54 inch.

140. Apparatus according to claim 136 wherein the piece of copper is a copper pad measuring about 2.8 inches by 1.7 inches.

141. Apparatus according to claim 137 wherein the piece of copper is a copper pad measuring about 2.8 inches by 1.7 inches.

142. Apparatus according to claim 122 wherein the support plate is copper, the lead wires comprise a pair of parallel AWG 12 wires electrically connected to one hot junction of the dimmer circuit and a pair of parallel AWG 12 wires electrically connected to another hot junction of the dimmer circuit, and wherein the triac is in thermal connection with a copper pad that is in thermal connection with the support plate, there being a beryllium oxide disk interposed between the triac and the copper pad, at least one of the pair of parallel wires being dressed in a substantially U-shaped pattern in the vicinity of the dimmer circuit.

143. Apparatus according to claim 123 wherein the support plate is aluminum, the lead wires are AWG 10 wire and the triac is in thermal connection with a copper strip that is in thermal connection with the support plate, there being a berrylium oxide disk interposed between the triac and the copper strip, at least one of the wires being dressed in a substantially U-shaped pattern in the vicinity of the dimmer circuitry.

144. Apparatus according to claim 123 further comprising a housing disposed adjacent the rear surface of the support plate and covering the dimmer circuit, a first means thermally isolating the housing from the support plate and a second means thermally isolating the wall box from the support plate.

145. Apparatus according to claim 144 wherein the first means comprises a plastic shield and the second means comprises a piece of fishpaper.

146. Apparatus according to claim 125 wherein the support plate is copper, the lead wires comprise a pair of parallel AWG 12 wires electrically connected to one hot junction of the dimmer circuit and a pair of parallel AWG 12 wires electrically connected to another hot junction of the dimmer circuit, and wherein the triac is in thermal connection with a copper pad that is in thermal connection with the support plate, there being a beryllium oxide disk interposed between the triac and the copper pad, at least one of the pair of parallel wires being dressed in a substantially U-shaped pattern in the vicinity of the dimmer circuit.

147. Apparatus according to claim 126 wherein the support plate is aluminum, the lead wires are AWG 10 wires and the triac is in thermal connection with a copper strip that is in thermal connection with the support plate, there being a berrylium oxide disk interposed between the triac and the copper strip, at least one o the wires being dressed in a substantially U-shaped pattern in the vicinity of the dimmer circuitry.

148. Apparatus according to claim 126 further comprising a housing disposed adjacent the rear surface of the support plate and covering the dimmer circuit, a first means thermally isolating the housing from the support plate and a second means thermally isolating the wall box from the support plate.

149. Apparatus according to claim 148 wherein the first means comprises a plastic shield and the second means comprises a piece of fishpaper.

150. Apparatus according to claim 142 wherein the copper pad measures about 2.8 inches by 1.7 inches.

151. Apparatus according to claim 143 wherein the copper strip measures about 1.23 inches by 0.54 inch.

152. Apparatus according to claim 146 wherein the copper pad measures about 2.8 inches by 1.7 inches.

153. Apparatus according to claim 147 wherein the copper strip measures about 1.23 inches by 0.54 inch.

154. Apparatus comprising:

a. a generally rectangular support plate for mounting to a wall box embedded in a wall and having overall surface dimensions greater than the corresponding dimensions of the wall box, a generally flat front and rear surface, the front surface having a pair of upstanding portions disposed along vertical opposing side edges of the support plate and extending generally perpendicularly outward therefrom;

b. a generally rectangular cover plate juxtaposed over the front surface of the support plate so as to provide a low profile with the wall surface supporting the support plate and having front and rear surfaces, the overall surface dimensions being greater than corresponding dimensions of the support plate including first portions that extend over the upstanding portions of the support plate, the ratio of (i) the distance between the rear surface of the support plate and the rear most surface of the cover plate to (ii) the distance by which the first portions extend over the upstanding portions being less than approximately two to one, the rear surface of the cover plate being spaced from the front surface of the support plate by a distance no greater than about 0.15 inch so as to provide an air gap there between, the first portions casting a shadow along vertical sides of the support plate, the vertical sides of the support plate being visible only when viewed at angles greater than 25° with respect to an imaginary line perpendicular to the plane of the support plate, thereby giving the appearance that the cover plate is floating from the wall;

c. an electric circuit having a heat generating controllably conductive device therein, the controllably conductive device in thermal association with the support plate and adapted to be connected in series with a controlled load and electrically coupled to the lead wires of a power source within the wall box;

d. a chimney between the support plate and the cover plate through which air currents may flow and being defined by the combination of the pair of upstanding portions, the air gap and open opposing horizontal side edges of the support plate defining inlets and outlets of the chimney;

e. means for removably and invisibly affixing the cover plate to the support plates;

f. a generally centrally disposed first opening in the support plate and a corresponding generally centrally disposed second opening in the cover plate in substantial alignment with the first opening;

g. a push button on-off switch disposed adjacent the rear surface of the support plate and having a depressible operating member extending through the first opening; and h. a depressible control button disposed in the second opening and being operable when depressed to depress the operating member and thereby open and close the switch.

155. Apparatus according to claims 118 or 154 wherein the means for invisibly attaching the cover plate to the support plate comprises a pair of separate rails affixed to the front surface of the support plate and a plurality of tabs disposed on the rear surface of the cover plate adapted to snap onto corresponding portions of the rails.

156. Apparatus according to claim 155 wherein the rails are separate from each other and are separately formed from the support plate and are affixed to the support plate by a plurality of spaced eyelets, the tabs being in substantial alignment with the eyelets.

157. Apparatus according to claim 156 wherein the rails are constructed of aluminum.

158. Apparatus according to claim 156 wherein the rails are constructed of nylon.

159. A wall mounted dimmer switch for controlling loads that draw currents up to about 8.33 amps comprising:

a. a metal support plate for mounting to a wall box having a width A, the support plate having generally flat front and rear surfaces and a width no greater than about 1.5A and a length no greater than 3A;

b. a dimmer circuit disposed adjacent the rear surfaces of the support plate including a heat generating controllably conductive means in thermal connection with the support plate and at least a pair of lead wires for connection to the field wiring within the wall box and electrically coupled in series with a load, the load current being carried by the controllably conductive means for a dimming range up to at least 95% of the full voltage that may be applied to the load, the maximum temperature rise of the field wiring terminals and on the conductors of the lead wires intended for field wiring being no greater than 30° C., the maximum temperature rise of any part of the dimmer circuit that can contact field wiring being no greater than 35° C., and the maximum temperature rise of any other part of the dimmer circuit that is exposed on the outside being no greater than 65° C. when the dimmer circuit is controlling a load that is drawing up to 8.33 amps.

160. A wall mounted dimmer switch for controlling loads that draw currents up to about 11.67 amps comprising:

a. a metal support plate for mounting to a wall box having a width A, the support plate having generally flat front and rear surfaces and a width no greater than about 2.5A and a length no greater than 3A;

b. a dimmer circuit disposed adjacent the rear surfaces of the support plate including a heat generating controllably conductive means of thermal connection with the support plate and at least a pair of lead wires for connection to field wiring within the wall box and electrically coupled in series with a load, the load current being carried by the controllably conductive means for a dimming range up to at least 95% of the full voltage that may be applied to the load, the maximum temperature rise of the field wiring terminals and on the conductors of the lead wires intended for field wiring being no greater than 30° C., the maximum temperature rise of any part of the dimmer circuit that can contact field wiring being no greater than 35° C., and the maximum temperature rise of any other part of the dimmer circuit that is exposed on the outside being no greater than 65° C. when the dimmer circuit is controlling a load that is drawing up to 11.67 amps.

161. A wall mounted dimmer switch for controlling loads that draw currents up to about 12.5 amps comprising:

a. a metal support plate for mounting to a wall box having a width A, the support plate having generally flat front and rear surfaces and a width no greater than about 2.5A and a length no greater than 3A;

b. a dimmer circuit disposed adjacent the rear surfaces of the support plate including a heat generating controllably conductive means of thermal connection with the support plate and at least a pair of lead wires for connection to field wiring within the wall box and electrically coupled in series with a load, the load current being carried by the controllably conductive means for a dimming range up to at least 95% of the full voltage that may be applied to the load, the maximum temperature rise of the field wiring terminals and on the conductors of the lead wires intended for field wiring being no greater than 30° C., the maximum temperature rise of any part of the dimmer circuit that can contact field wiring being no greater than 35° C., and the maximum temperature rise of any other part of the dimmer circuit that is exposed on the outside being no greater than 65° C. when the dimmer circuit is controlling a load that is drawing up to 12.5 amps.

162. A wall mounted dimmer switch for controlling loads that draw currents up to about 8.33 amps comprising:

a. a metal support plate having an overall surface area no greater than about 26 square inches;

b. a dimmer circuit disposed adjacent the rear surface of the support plate including a heat generating controllably conductive means in thermal connection with the support plate and at least a pair of lead wires for connection to field wiring within a wall box, the load current being carried by a controllably conductive means for a dimming range of up to at least 95% of the full voltage that may be applied to the load, the maximum temperature rise of the field wiring terminals and on the conductors of the lead wires intended for field wiring being no greater than 35° C., the maximum temperature rise of any part of the dimmer circuit that can contact field wiring being no greater than 35° C., and the maximum temperature rise of any other part of the dimmer circuit that is exposed on the outside being no greater than 65° C. when the dimmer circuit is controlling a load that is drawing up to 8.33 amps.

163. A wall mounted dimmer switch for controlling loads that draw currents up to about 11.67 amps comprising:

a. a metal support plate having an overall surface area no greater than about 44 square inches;

b. a dimmer circuit disposed adjacent the rear surface of the support plate including a heat generating controllably conductive means in thermal connection with the support plate and at least a pair of lead wires for connection to field wiring within a wall box, the load current being carried by a controllably conductive means for a dimming range of up to at least 95% of the full voltage that may be applied to the load, the maximum temperature rise of the field wiring terminals and on the conductors of the lead wires intended for field wiring being no greater than 35° C., the maximum temperature rise of any part of the dimmer circuit that can contact field wiring being no greater than 35° C., and the maximum temperature rise of any other part of the dimmer circuit that is exposed on the outside being no greater than 65° C. when the dimmer circuit is controlling a load that is drawing up to 11.67 amps.

164. A wall mounted dimmer switch for controlling loads that draw currents up to about 12.5 amps comprising:

a. a metal support plate having an overall surface area no greater than about 44 square inches;

b. a dimmer circuit disposed adjacent the rear surface of the support plate including a heat generating controllably conductive means in thermal connection with the support plate and at least a pair of lead wires for connection to field wiring within a wall box, the load current being carried by a controllably conductive means for a dimming range of up to at least 95% of the full voltage that may be applied to the load, the maximum temperature rise of the field wiring terminals and on the conductors of the lead wires intended for field wiring being no greater than 35° C., the maximum temperature rise of any part of the dimmer circuit that can contact field wiring being no greater than 35° C., and the maximum temperature rise of any other part of the dimmer circuit that is exposed on the outside being no greater than 65° C. when the dimmer circuit is controlling a load that is drawing up to 12.5 amps.

165. Apparatus according to claims 159 or 162 wherein the controllably conductive means is a triac having a forward voltage drop of no greater than about 1 volt at a forward current of about 8.33 amps.

166. Apparatus according to claims 160 or 163 wherein the controllably conductive means is a triac having a forward voltage drop of no greater than about 1.05 volts at a forward current of about 11.67 amps.

167. Apparatus according to claims 161 or 164 wherein the controllably conductive means is a triac having a forward voltage drop of no greater than about 1.05 volts at a forward current of about 12.5 amps.

168. Apparatus according to claim 159 wherein the support plate measures no greater than about 2¾ inches in width and 4½ inches in length.

169. Apparatus according to claim 160 wherein the support plate measures no greater than about 4½ inches square.

170. Apparatus according to claim 161 wherein the support plate measures no greater than about 4½ inches square.

171. Apparatus according to claims 159 or 162 wherein the support plate is aluminum, the lead wires or AWG 12 wire and the controllably conductive means is a triac disposed over and in thermal connection with a piece of copper that is in thermal connection with the support plate, there being a beryllium oxide disk interposed between the triac and the piece of copper, at least one of the lead wires being dressed in a substantially U-shaped pattern in the vicinity of the dimmer circuitry.

172. Apparatus according to claim 171 wherein the piece of copper is a copper strip measuring about 1.23 inches by 0.54 inch.

173. Apparatus according to claim 171 wherein the piece of copper is a copper pad measuring about 2.8 inches by 1.7 inches.

174. Apparatus according to claims 160 or 163 wherein the support plate is copper, the lead wires comprise a pair of parallel AWG 12 wires electrically connected to one hot junction of the dimmer circuit and a pair of parallel AWG 12 wires electrically connected to another hot junction of the dimmer circuit, and wherein the controllably conductive means is a triac in thermal connection with a copper pad that is in thermal connection with the support plate, there being a beryllium oxide disk interposed between the triac and the copper pad, at least one of the pair of parallel wires being dressed in a substantially U-shaped pattern in the vicinity of the dimmer circuit.

175. Apparatus according to claim 161 or 164 wherein the support plate is aluminum, the lead wires are AWG 10 wire and the controllably conductive means is a triac in thermal connection with a copper strip that is in thermal connection with the support plate, there being a berrylium oxide disk interposed between the triac and the copper strip, at least one of the wires being dressed in a substantially U-shaped pattern in the vicinity of the dimmer circuitry.

176. Apparatus according to claims 161 or 164 further comprising a housing disposed adjacent the rear surface of the support plate and covering the dimmer circuit, a first means thermally isolating the interior of the housing from the support plate and a second means thermally isolating the wall box from the support plate.

177. Apparatus according to claim 176 wherein the first means comprises a plastic shield and the second means comprises a piece of fishpaper.

178. Apparatus according to claim 174 wherein the copper pad measures about 2.8 inches by 1.7 inches.

179. Apparatus according to claim 175 wherein the copper strip measures about 1.23 inches by 0.54 inch.

180. Apparatus according to claim 174 wherein the support plate is painted black.

181. Apparatus according to claim 174 wherein the support plate has a matt finish.

182. In a wall mounted dimmer switch of the type having a support plate for mounting to a wall box embedded in a wall and having overall surface dimensions greater than the corresponding dimensions of the wall box, a dimmer circuit disposed adjacent the rear thereof, a housing covering the dimmer circuit and at least a pair of lead wires extending through the housing for connection to field wiring within the wall box and for delivering supply and load current to and from the dimmer circuit, means for maintaining the maximum temperature rise of selected portions of the dimmer switch within predetermined limits, comprising: a first pair of electrically paralleled wires carrying current from a first hot junction of the dimmer circuit to at least one of the lead wires and a second pair of electrically paralleled wires carrying current from a second hot junction of the dimmer circuit to at least one of the lead wires, each of the first and second pairs of wires being disposed at least within the housing.

183. A wall mounted dimmer switch according to claim 182 wherein the first pair of parallel wires is connected to a first single lead wire within the housing and the second pair of parallel wires is connected to a second single lead wire within the housing.

184. Dimmer according to claim 182 wherein the first and second pairs of parallel wires extend through the housing and define the lead wires.

185. A wall mounted dimmer switch according to claim 182 wherein the first pair of parallel wires together, and the second pair of parallel wires together, each have a combined current carrying cross sectional area greater than that required of a single wire to safely carry full load and surge currents conducted through the dimmer circuit, but each one of the wires in the first and second pairs of parallel wires individually having a current carrying cross sectional area less than that required of a single wire to safely carry the full load and surge currents.

186. A wall mounted dimmer switch according to claim 182, wherein the following relationship is exhibited, $T_{LUG} > T_A > T_{LEAD}$, where $T_{LUG}$ is the greatest temperature measured at a hot junction, $T_A$ is the greatest temperature measured within the housing, and $T_{LEAD}$ is the greatest temperature of the conductors of the lead wires measured at the point where the lead wires exit the housing.

187. A wall mounted dimmer switch according to claims 182, 183 or 184 wherein the dimmer circuit is of the type for controlling loads that draw currents of up to at least 11.67 amps, and each of the wires of the first and second pair of wires is an AWG 12 wire.

188. A wall mounted dimmer switch according to claims 182, 183 or 184 wherein the dimmer circuit is of the type for controlling loads that draw currents of up to at least 11.67 amps, and each of the wires of the first and second pair of wires is an AWG 14 wire.

189. A wall mounted dimmer switch according to claim 183 wherein the dimmer circuit is of the type for controlling loads that draw currents of up to at least 11.67 amps, each of the wires of the first and second pairs of parallel wires being an AWG 12 wire and each of the first and second single lead wire being an AWG 10 wire.

190. A wall mounted dimmer switch according to claim 182 wherein the selected portions of the dimmer switch are the conductors of the lead wires intended for field wiring, any part of the dimmer switch that can contact field wiring and any other part of the dimmer switch that is exposed on the outside and the pre-determined temperature limits are: no greater than a 30° C. temperature rise on the conductors of the lead wires intended for field wiring; no greater than a 35° C. temperature rise on any part of the dimmer switch that can contact field wiring; and, no greater than a 65° C. temperature rise on any other part of the dimmer switch that is exposed on the outside.

191. A wall mounted dimmer switch according to claim 182 wherein the dimmer circuit comprises a triac in thermal connectio with the support plate.

192. A wall mounted dimmer switch according to claim 187 wherein the support plate dimensions correspond to the dimensions of the wall box, the wall box having a width A, and the support plate having generally flat front and rear surfaces, a width no greater than 2.5A and a length no greater than about 3A.

193. A wall mounted dimmer switch according to claim 192 wherein the support plate measures no greater than about 4½ inches square.

194. A wall mounted dimmer switch according to claim 181 wherein the support plate has an overall surface area no greater than about 44 square inches.

195. A wall mounted dimmer switch according to claim 190 wherein at least one of the pairs of parallel wires is dressed in a substantial U-shaped curve in the vicinity of the dimmer circuit.

196. A wall mounted dimmer switch according to claims 182, 183 or 184 wherein the dimmer circuit comprises a RFI choke.

197. A wall mounted dimmer switch of the type to be mounted to a wall box recessed within a wall surface, the dimmer switch comprising: a support plate adapted to be mounted over and substantially covering the wall box, a dimmer circuit adapted to be disposed within the wall box adjacent the rear surface of the support plate and including controllably conductive means in thermal connection with the support plate, a housing covering the dimmer circuit and attached to the support plate, and thermal isolating means in thermal association with the support plate, said isolating means adapted to limit the maximum temperature rise to no greater than 30° C. on conductors of lead wires intended for the field wiring, no greater than 35° C. on any part of the dimmer switch that can contact the field wiring, and no greater than 65° C. on any other part of the dimmer circuit that is exposed, including the housing.

198. A wall mounted dimmer switch according to claim 197 wherein the thermal isolating means comprises means for thermally isolating the interior of the housing from the support plate.

199. A wall mounted dimmer switch according to claim 197 or 198 wherein the thermal isolating means comprises means for thermally isolating the wall box from the support plate.

200. Dimmer switch according to claim 197 wherein the thermal isolating means comprises first means disposed between the housing and the support plate for thermally isolating the interior of the housing from the support plate and second means disposed on the rear surface of the support plate for contact with the wall box for thermally isolating the wall box from the support plate.

201. Dimmer switch according to claim 200 wherein the first means comprises a plastic heat shield and the second means comprises a piece of fishpaper.

202. Dimmer switch according to claim 201 wherein the plastic heat shield has a hollow interior so as to provide an air gap between the interior of the housing and the support plate.

203. Dimmer circuit according to claim 201 wherein the fishpaper thermally insulates the support plate from substantially all portions of the wall box when the dimmer switch has been installed.

204. Dimmer circuit according to claim 197 wherein the wall box has a width A, the support plate is substantially flat and has a width no greater than about 2.5A and a length no greater than about 3A.

205. Dimmer circuit according to claim 197 wherein the support plate measures no greater than about 4½ inches square.

206. Dimmer circuit according to claim 197 wherein the support plate has an overall surface area no greater than about 44 square inches.

207. Dimmer circuit according to claim 204 wherein the dimmer circuit is of the type for controlling loads that draw up to 12.5 amps.

208. Dimmer circuit according to claim 206 wherein the dimmer circuit is of the type for controlling loads that draw up to 12.5 amps.

209. Dimmer circuit according to claim 207 or 208 wherein the controllably conductive means comprises a triac, and the triac carries the load current for a dimming range up to at least 95% of full voltage that may be applied to a load.

210. Dimmer circuit according to claim 207 or 208 wherein the controllably conductive means comprises a triac having a forward voltage drop of no greater than about 1.05 volts at a forward current of about 12.5 amps.

211. Dimmer circuit according to claim 210 wherein the support plate is aluminum, the lead wires are AWG 10 wires and the triac is disposed over and in thermal connection with a strip of copper that is in thermal connection with the support plate, there being a beryllium oxide disk interposed between the triac and the strip of copper, at least one of the lead wires being dressed in a substantially U-shaped pattern in the vicinity of the dimmer circuitry.

212. A low profile dimmer switch for controlling loads that draw currents of up to 12.5 amps comprising:

(a) a support plate for mounting to a wall box;

(b) a dimmer circuit disposed adjacent the rear surface of the support plate, including a triac in thermal connection with the support plate and a pair of AWG 10 lead wires for connection to the field wiring of the wall box, the dimmer circuit being adapted to carry the load current for a dimming range of up to at least 95% of the full voltage that may be applied to a load, and the triac having a forward voltage drop of no greater than about 1.05 volts at a forward current of about 12.5 amps;

(c) a housing disposed over an covering the dimmer circuit and adapted to be positioned within the wall box when the support plate is mounted thereto;

(d) first means for thermally isolating the interior of the housing from the support plate; and (e) second means for thermally isolating the wall box from the support plate; the maximum temperature rise of the field wiring terminals and the conductors of the lead wires intended for field wiring being no greater than 30° C., the maximum temperature rise of any part of the dimmer switch that can contact field wiring being no greater than 35° C., the maximum temperature rise of any other part of the dimmer switch that is exposed on the outside being no greater than 65° C. when the dimmer circuit is controlling a load that is drawing up to 12.5 amps.

213. Dimmer circuit according to claim 212 wherein the support plate is aluminum.

214. Dimmer circuit according to claim 212 wherein the support plate is substantially flat, the wall box has a width A, the support plate has a width no greater than about 2.5A and a length no greater than about 3A.

215. Dimmer circuit according to claim 214 wherein the support plate measures about 4½ inches square.

216. Dimmer circuit according to claim 212 wherein the support plate has an overall surface area no greater than about 44 square inches.

217. Dimmer circiut according to claim 212 wherein the first means comprises a plastic heat shield disposed between the housing and the support plate.

218. Dimmer circuit according to claim 212 wherein the second means comprises a piece of fishpaper disposed on the rear surface of the support plate for contact with the wall box.

* * * * *